US006813894B2

(12) United States Patent
Maeda

(10) Patent No.: US 6,813,894 B2
(45) Date of Patent: Nov. 9, 2004

(54) HEAT PUMP AND DEHUMIDIFIER

(75) Inventor: Kensaku Maeda, Kanagawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/149,414

(22) PCT Filed: Mar. 7, 2001

(86) PCT No.: PCT/JP01/01784

§ 371 (c)(1),
(2), (4) Date: Jun. 20, 2002

(87) PCT Pub. No.: WO02/070960

PCT Pub. Date: Sep. 12, 2002

(65) Prior Publication Data

US 2003/0121276 A1 Jul. 3, 2003

(51) Int. Cl.[7] ..... F25D 17/06
(52) U.S. Cl. ..... 62/93; 62/94
(58) Field of Search ..... 62/94, 271, 272, 62/524, 525, 526, 93, 277

(56) References Cited

U.S. PATENT DOCUMENTS

| | | | | | |
|---|---|---|---|---|---|
| 4,887,438 | A | | 12/1989 | Meckler | 62/271 |
| 5,031,411 | A | | 7/1991 | Gehring et al. | 62/93 |
| 5,251,458 | A | | 10/1993 | Tchernev | 62/271 |
| 5,622,057 | A | | 4/1997 | Bussjager et al. | |
| 5,943,874 | A | * | 8/1999 | Maeda | 62/271 |
| 6,029,467 | A | * | 2/2000 | Moratalla | 62/271 |
| 6,247,323 | B1 | * | 6/2001 | Maeda | 62/271 |
| 6,311,511 | B1 | * | 11/2001 | Maeda | 62/271 |
| 6,318,106 | B1 | * | 11/2001 | Maeda | 62/271 |
| 6,334,316 | B1 | * | 1/2002 | Maeda et al. | 62/94 |
| 6,393,850 | B1 | * | 5/2002 | Vanderstraeten | 62/196.3 |

FOREIGN PATENT DOCUMENTS

| | | |
|---|---|---|
| EP | 0 191 007 | 8/1986 |
| EP | 1 231 438 | 8/2002 |
| JP | 3-95331 | 4/1991 |
| JP | 2761379 | 3/1998 |
| JP | 10-288421 | 10/1998 |
| JP | 3049445 | 3/2000 |
| JP | 2000-356481 | 12/2000 |
| WO | WO 94/00725 | 1/1994 |
| WO | WO 98/46958 | 10/1998 |
| WO | WO 00/00774 | 1/2000 |
| WO | WO00/16016 | 3/2000 |

OTHER PUBLICATIONS

Supplementary European Search Report dated Mar. 25, 2003.

* cited by examiner

*Primary Examiner*—William Doerrler
*Assistant Examiner*—Mohammad m. Ali
(74) *Attorney, Agent, or Firm*—Westerman, Hattori, Daniels & Adrian, LLP

(57) ABSTRACT

There are provided a heat pump having a high COP and a dehumidifying apparatus arranged in a compact size. The heat pump has a pressurizer 260 for raising a pressure of a refrigerant 260, an evaporator 210 for cooling a low-temperature heat source fluid A with heat of evaporation of the refrigerant to be pressurized, a condenser 220 for heating a high-temperature heat source fluid B with heat of condensation of the pressurized refrigerant, and a first heat exchanger 300*a* for exchanging heat between the low-temperature heat source fluid A upstream of the evaporator 210 and a cooling fluid. The first heat exchanger 300*a* has a first compartment 310 through which the low-temperature heat source fluid A flows, a second compartment 320 through which the cooling fluid flows, and refrigerant passages 251A1-A9, 252A1-A9 extending through the first compartment and the second compartment. The refrigerant passages 251A1-A9, 252A1-A9 are connected to the condenser 220 through a first restriction 330, extend alternately through the first compartment and the second compartment repeatedly, and then are connected to the evaporator 210 through a second restriction 250. Since the refrigerant passes through the first and second compartments a plurality of times, the refrigerant will not completely be dried out in the refrigerant passage extending through the first compartment.

2 Claims, 18 Drawing Sheets

HEAT PUMP AND DEHUMIDIFIER

TECHNICAL FIELD

The present invention relates to a heat pump and a dehumidifying apparatus, and more particularly to a heat pump with a high COP and a dehumidifying apparatus which has such a heat pump.

BACKGROUND ART

As shown in FIG. 17, there has heretofore been available a desiccant air-conditioning apparatus having a heat pump as a heat source. The air-conditioning apparatus shown in FIG. 17 employs a compression type heat pump HP including a compressor 260 as the heat pump. The air-conditioning apparatus has a path for process air A from which moisture is adsorbed by a desiccant wheel 103, and a path for regeneration air B which is heated by a heating source and then passes through the desiccant wheel 103 which has adsorbed the moisture, to desorb the moisture from the desiccant for thereby regenerating the desiccant. The air-conditioning apparatus has an air-conditioner having a sensible heat exchanger 104 for exchanging heat between the process air from which moisture has been adsorbed and the regeneration air before it regenerates the desiccant of the desiccant wheel 103 and also before it is heated by the heating source, and also has the compression type heat pump HP. The regeneration air of the air-conditioner for regenerating the desiccant is used as a high-temperature heat source in the compression type heat pump HP, and is heated by a heating unit 220. The process air of the air-conditioner is used as a low-temperature heat source in the compression type heat pump HP, and is cooled by a cooling unit 210.

Here, operation of the compression type heat pump HP shown in FIG. 17 will be described below with reference to a Mollier diagram shown in FIG. 18. The diagram shown in FIG. 18 is a Mollier diagram in the case where HFC134a is used as the refrigerant. A point a represents a state of the refrigerant evaporated by the cooling unit 210, and the refrigerant is in the form of a saturated vapor. The refrigerant has a pressure of 4.2 kg/cm$^2$, a temperature of 10° C., and an enthalpy of 148.83 kcal/kg. A point b represents a state of the vapor drawn and compressed by the compressor 260, i.e., a state at the outlet port of the compressor 260. In this state, the refrigerant has a pressure of 19.3 kg/cm$^2$ and a temperature of 78° C., and is in the form of a superheated vapor. The refrigerant vapor is cooled in the heating unit (as a cooling unit or a condenser from the viewpoint of the refrigerant) 220 and reaches a state represented by a point c in the Mollier diagram. In the point c, the refrigerant is in the form of a saturated vapor and has a pressure of 19.3 kg/cm$^2$ and a temperature of 65° C. Under this pressure, the refrigerant is further cooled and condensed to reach a state represented by a point d. In the point d, the refrigerant is in the form of a saturated liquid and has the same pressure and temperature as those in the point c. The saturated liquid has an enthalpy of 122.97 kcal/kg. The refrigerant liquid is depressurized by an expansion valve 250 to a saturation pressure of 4.2 kg/cm$^2$ at a temperature of 10° C. The refrigerant is delivered as a mixture of the refrigerant liquid and the vapor at a temperature of 10° C. to the cooling unit (as an evaporator from the viewpoint of the refrigerant) 210, where the mixture removes heat from process air and is evaporated to reach a state of the saturated vapor, which is represented by the point a in the Mollier diagram. The saturated vapor is drawn into the compressor 260 again, and the above cycle is repeated.

The heat pump used in the above conventional air-conditioning apparatus does not have an excellent COP because the cooling effect of a refrigerant in a refrigerant cycle is not necessarily large. In the conventional air-conditioning apparatus, the sensible heat exchanger 104 for preliminarily cooling the process air before the process air is cooled by the cooling unit 210 plays an important role. However, since the sensible heat exchanger generally occupies a large volume in the system, it is difficult to construct the system, and the system unavoidably becomes large in size.

It is therefore an object of the present invention to provide a heat pump having a high COP and a dehumidifying apparatus which has a high COP and a compact structure.

DISCLOSURE OF INVENTION

According to an aspect of the present invention, as shown in FIGS. 1 and 2, for example, there is provided a heat pump HP 1 in which a pressurizer 260, a condenser 220, and an evaporator 210 are interconnected via refrigerant paths 201-207, the heat pump comprising: means disposed in the refrigerant path interconnecting the condenser 220 and the evaporator 210, for alternately evaporating and condensing a refrigerant repeatedly under an intermediate pressure which is located intermediately between a pressure to be pressurized by the pressurizer 260 and a pressure which has been pressurized by the pressurizer 260 (from a point e to a point f1 and from a point f1 to a point g1a and the like in FIG. 3).

The heat pump may be arranged such that while the refrigerant is alternately being evaporated and condensed repeatedly as shown in a flow diagram shown in FIG. 9 and a corresponding Mollier diagram shown in FIG. 10, for example, the condensed refrigerant is condensed after it is depressurized to a second intermediate pressure lower than the previous intermediate pressure (from a point g2 to a point E in FIG. 10). For example, the heat pump may have two means for alternately evaporating and condensing the refrigerant repeatedly as shown in a flow diagram shown in FIG. 12 and a corresponding Mollier diagram shown in FIG. 13, and the heat pump may be arranged such that the evaporation pressure and the condensation pressure in one of the means is made lower than the evaporation pressure and the condensation pressure in the other means, and while the refrigerants are alternately being evaporated and condensed repeatedly by the respective means, the condensed refrigerants are concurrently depressurized to an evaporation pressure in the evaporator (from a point g2 to a point j1 and from a point G2 to a point j in FIG. 13).

According to an aspect of the present invention, there is provided a dehumidifying air-conditioning apparatus comprising: a moisture adsorbing device 103 for removing moisture from process air and for being regenerated by desorbing moisture therefrom with regeneration air; and a heat pump HP1 having a condenser 220, an evaporator 210, and a thin pipe group interconnecting the condenser 220 and the evaporator 210; wherein the thin pipe group is arranged so as to introduce a refrigerant condensed by the condenser 220 to the evaporator 210 and to bring the refrigerant into alternate contact with the process air and the regeneration air.

As shown in FIG. 12 or FIG. 14, for example, there may be two of the above thin pipe group, the refrigerant path for introducing the refrigerant from the condenser to the thin pipe groups may be branched into two passages which are connected respectively to the two of the thin pipe groups, and refrigerant pipes extending from the respective thin pipe groups may be joined to each other at the inlet of the evaporator or directly in the evaporator.

According to another aspect of the present invention, as shown in FIGS. 1 and 2, for example, there is provided a heat pump comprising: a pressurizer 260 for raising a pressure of a refrigerant; an evaporator 210 for cooling a low-temperature heat source fluid A with heat of evaporation of the refrigerant to be pressurized by the pressurizer 260; a condenser 220 for heating a high-temperature heat source fluid B with heat of condensation of the refrigerant pressurized by the pressurizer 260; and a first heat exchanger 300*a* for exchanging heat between the low-temperature heat source fluid A upstream of the evaporator 210 and a cooling fluid; wherein the first heat exchanger 300*a* has a first compartment 310 through which the low-temperature heat source fluid A flows, a second compartment 320 through which the cooling fluid flows, and refrigerant passages 215A1-A9, 252A1-A9 extending through the first compartment 310 and the second compartment 320, the refrigerant passages 215A1-A9, 252A1-A9 being connected to the condenser 220 through a first restriction 330, extending alternately through the first compartment 310 and the second compartment 320 repeatedly, and then being connected to the evaporator 210 through a second restriction 250. The cooling fluid should preferably comprise the high-temperature heat source fluid B. Particularly, the cooling fluid which is to exchange heat with the cold heat source fluid upstream of the evaporator in the first heat exchanger 300*a* should preferably comprise the high-temperature heat source fluid B upstream of the condenser 220.

In the refrigerant passage, the refrigerant typically flows in one direction as a whole. This means that the refrigerant flows in substantially one direction through the refrigerant passage when views as a whole even though the refrigerant may locally flow back due to turbulences or may be vibrated in the flowing direction due to pressure waves produced by bubbles or instantaneous interruptions. The refrigerant passage comprises a heat exchange tube, for example, and extends alternately through the first compartment and the second compartment. Therefore, the refrigerant which flows in one direction as a whole is alternately evaporated and condensed repeatedly. The expression that the refrigerant passage extends alternately through the first compartment and the second compartment means that the refrigerant passage does not run through the first compartment and the second compartment only once, but the refrigerant passage runs through the first compartment and the second compartment once and then runs at least once through the second compartment or the first compartment. In the first compartment, the low-temperature heat source fluid exchanges heat with the refrigerant, and in the second compartment, the high-temperature heat source fluid exchanges heat with the refrigerant. Typically, the refrigerant is at least partly evaporated in the refrigerant passage which extends through the first compartment, and the refrigerant in the vapor phase is at least partly evaporated in the refrigerant passage which extends through the second compartment.

With the above arrangement, since the refrigerant passes through the first and second compartments a plurality of times, the refrigerant will not completely be dried out even if it is evaporated in the refrigerant passage extending through the first compartment.

In the heat pump, the first compartment 310 and the second compartment 320 may be arranged such that the low-temperature heat source fluid A and the cooling fluid flow as counterflows; the refrigerant passage in the first compartment 310 and the second compartment 320 may have at least a pair of a first compartment extending portions 251A1 and a second compartment extending portions 252A1 in a first plane PA which is substantially perpendicular to the flows of the low-temperature heat source fluid A and the cooling fluid, at least a pair of a first compartment extending portions 251B1 and a second compartment extending portions 252B1 in a second plane PB, different from the first plane PA, which is substantially perpendicular to the flows of the low-temperature heat source fluid A and the cooling fluid, and an intermediate restriction 331 disposed in a transitional location from the first plane PA to the second plane PB.

In the portion of the refrigerant passage which extends through the first compartment, at least a portion of the refrigerant is typically evaporated. That portion of the refrigerant passage may thus be referred to as an evaporating section. In the portion of the refrigerant passage which extends through the second compartment, at least a portion of the refrigerant is typically condensed. That portion of the refrigerant passage may thus be referred to as a condensing section. The pair which is mentioned above refers to a pair of the evaporating section and the condensing section (or the condensing section and the evaporating section). Since the heat pump has the intermediate restriction, the pressure in the refrigerant passage in the first plane and the pressure in the refrigerant passage in the second plane may have different values. Since the low-temperature heat source fluid and the cooling fluid flow as counterflows, the different pressures become progressively lower in the downstream direction of the low-temperature heat source fluid or in the upstream direction of the cooling fluid. Therefore, the low-temperature heat source fluid and the cooling fluid perform counterflow heat exchange therebetween, resulting in an extremely high heat exchange efficiency.

In the above heat pump, the intermediate restriction 331 may be located in a position where the refrigerant passage has extended through the second compartment 320 as shown in FIG. 1, for example, or the intermediate restriction 331 may be located in a position where the refrigerant passage has extended through the first compartment 310 as shown in FIG. 6, for example.

For example, as shown in FIG. 12, the heat pump may further comprise a second heat exchanger 300*d*2 for exchanging heat between the low-temperature heat source fluid A upstream of the evaporator 210 and the cooling fluid; wherein the second heat exchanger 300*d*2 has a third compartment 310B through which the low-temperature heat source fluid A flows, a fourth compartment 320B through which the cooling fluid flows, and a refrigerant passage extending through the third compartment 310B and the fourth compartment 320B, the refrigerant passage being connected to the condenser 220 through a third restriction 330B, extending alternately through the third compartment 310B and the fourth compartment 320B repeatedly, and then being connected to the evaporator 210 through a fourth restriction 340B; and the third compartment 310B is disposed downstream of the first compartment 310A with respect to the low-temperature heat source fluid A, and the fourth compartment 320B is disposed upstream of the second compartment 320A with respect to the cooling fluid. The cooling fluid should preferably comprise the high-temperature heat source fluid B. Particularly, the cooling fluid which is to exchange heat with the cold heat source fluid upstream of the evaporator in the second heat exchanger 300*d*2 should preferably comprise the high-temperature heat source fluid B upstream of the condenser 220.

With the above arrangement, since the heat pump has the second heat exchanger 300*d*2, the heat pump can operate under a pressure different from the pressure of the first heat exchanger, thus increasing an overall heat exchange efficiency.

For example, as shown in FIG. 9, the heat pump may further comprise a third heat exchanger 300*c*2 for exchanging heat between the low-temperature heat source fluid A upstream of the evaporator 210 and the cooling fluid; wherein the third heat exchanger 300*c*2 has a fifth compartment 310B through which the low-temperature heat source fluid A flows, a sixth compartment 320B through which the cooling fluid flows, and a refrigerant passage extending through the fifth compartment 310B and the sixth compartment 320B, the refrigerant passage being connected to the refrigerant passage of the first heat exchanger 300*c*1 through a fifth restriction 340, extending alternately through the fifth compartment 310B and the sixth compartment 320B repeatedly, and then being connected to the evaporator 210 through the second restriction 250; and the fifth compartment 310B is disposed downstream of the first compartment 310A with respect to the low-temperature heat source fluid A, and the sixth compartment 320B is disposed upstream of the second compartment 320A with respect to the cooling fluid. The cooling fluid should preferably comprise the high-temperature heat source fluid B. Particularly, the cooling fluid which is to exchange heat with the cold heat source fluid upstream of the evaporator in the third heat exchanger 300*c*2 should preferably comprise the high-temperature heat source fluid B upstream of the condenser 220.

According to still another aspect of the present invention, as shown in FIGS. 1, 6, 9, and 12, for example, there is provided a dehumidifying apparatus comprising: the above heat pump; and a moisture adsorbing device 103 disposed upstream of the first heat exchanger with respect to the low-temperature heat source fluid A and having a desiccant for adsorbing moisture from the low-temperature heat source fluid A.

The low-temperature heat source fluid is typically the process air of the air-conditioning apparatus. Since the air-conditioning apparatus has a moisture adsorbing device, the humidity of the low-temperature heat source fluid can be lowered. The high-temperature heat source fluid is typically outside air as regeneration air.

The present dehumidifying apparatus should preferably be arranged so as to desorb the moisture of the desiccant with the high-temperature heat source fluid B which is heated by the condenser 220.

As shown in FIG. 3, for example, the object of the present invention can also be achieved by a method of transferring heat from a low-temperature heat source fluid A to a high-temperature heat source fluid B, the method comprising: a first step of evaporating a refrigerant by cooling a low-temperature heat source under a predetermined low pressure of 4.2 kg/cm$^2$ (from a point j to a point a); a second step of raising a pressure of the refrigerant which has been evaporated in the first step to a predetermined high pressure of 19.3 kg/cm$^2$ (from the point a to a point b); a third step of condensing the refrigerant pressurized in the second step under the predetermined high pressure to heat a high-temperature heat source fluid with heat of condensation (from the point b to a point d); a fourth step of depressurizing the refrigerant which has been condensed in the third step to a first intermediate pressure between the predetermined high pressure and the predetermined low pressure (from the point d, a point c to a point e); a fifth step of repeatedly evaporating the refrigerant depressurized in the fourth step by cooling the low-temperature heat source fluid and condensing the refrigerant by heating the high-temperature heat source fluid; and a sixth step of providing the refrigerant which has been condensed in the fifth step as the refrigerant to be evaporated in the first step. The transfer of heat is typically performed by the pumping of heat.

As shown in FIG. 3, for example, the repeated evaporation and condensation in the fifth step is achieved by evaporation by cooling the low-temperature heat source fluid A (from the point e to a point f1, from a point h1 to a point f2, from a point h2 to a point f3, from a point h3 to a point h4) and condensation by heating the high-temperature heat source fluid B (from the point f1 to a point g1a, from a point g1b to the point h1, from a point f2 to a point g2a, from a point g2b to the point h2, and the like). In the example shown in FIG. 3, the sixth step is a step (from a point h4 to the point j) of providing, as the refrigerant to be evaporated in the first step, the refrigerant which has been condensed (from the point f4 to the point h4) by heating the high-temperature heat source fluid B.

There may be provided a dehumidifying method comprising the above method of pumping heat, and, as shown in FIG. 4, for example, an eleventh step of adsorbing, with a desiccant, moisture contained in the low-temperature heat source fluid before it is cooled by evaporating the refrigerant in the fifth step (from a point K to a point L); and a twelfth step of desorbing moisture from the desiccant which has adsorbed the moisture in the eleventh step, with the high-temperature heat source fluid which has been heated by condensing the refrigerant in the third step (from a point T to a point U).

The present application is based on Japanese patent application No. 11-245022 filed on Aug. 31, 1999, which is incorporated herein as part of the disclosure of the present application.

The present invention can more fully be understood based on the following detailed description. Further applications of the present invention will become more apparent from the following detailed description. However, the following detailed description and specific examples will be described as preferred embodiments only for the purpose of explaining the present invention. It is evident to a person skilled in the art that various changes and modifications can be made to the embodiments in the following detailed description within the spirit and scope of the present invention.

The applicant has no intention to dedicate any of the embodiments described below to the public, and any of the disclosed modifications and alternatives which may not be included in the scope of the claims constitutes part of the invention under the doctrine of equivalent.

BEST MODE FOR CARRYING OUT THE INVENTION

Figure 1:
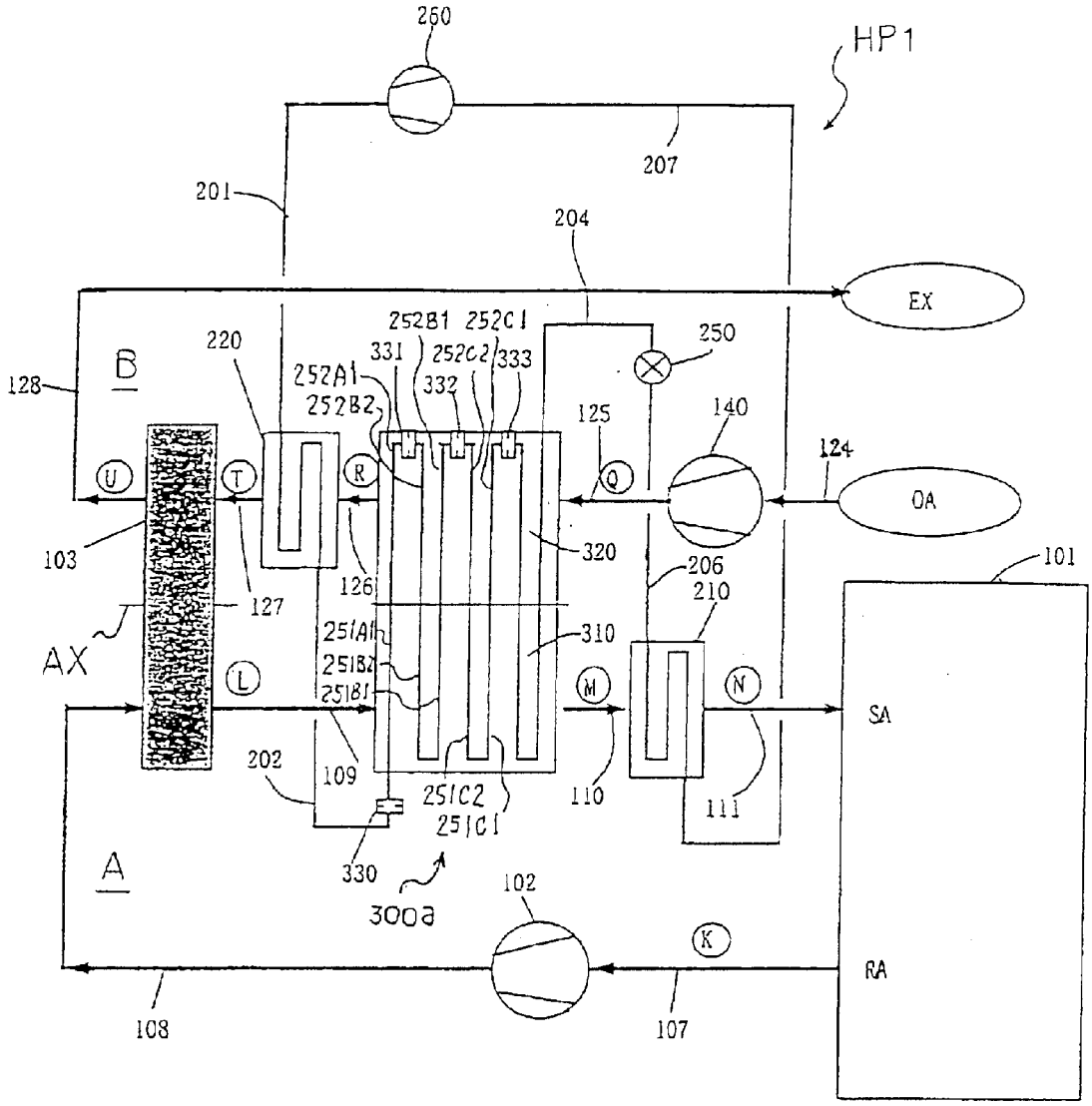
FIG. 1 is a flow diagram of a heat pump according to a first embodiment of the present invention and a dehumidifying air-conditioning apparatus having the heat pump.

Embodiments of the present invention will be described below with reference to the accompanying drawings. Identical or corresponding components are designated by the identical or like reference characters throughout drawings, and will not be described repetitively.

Figure 2:
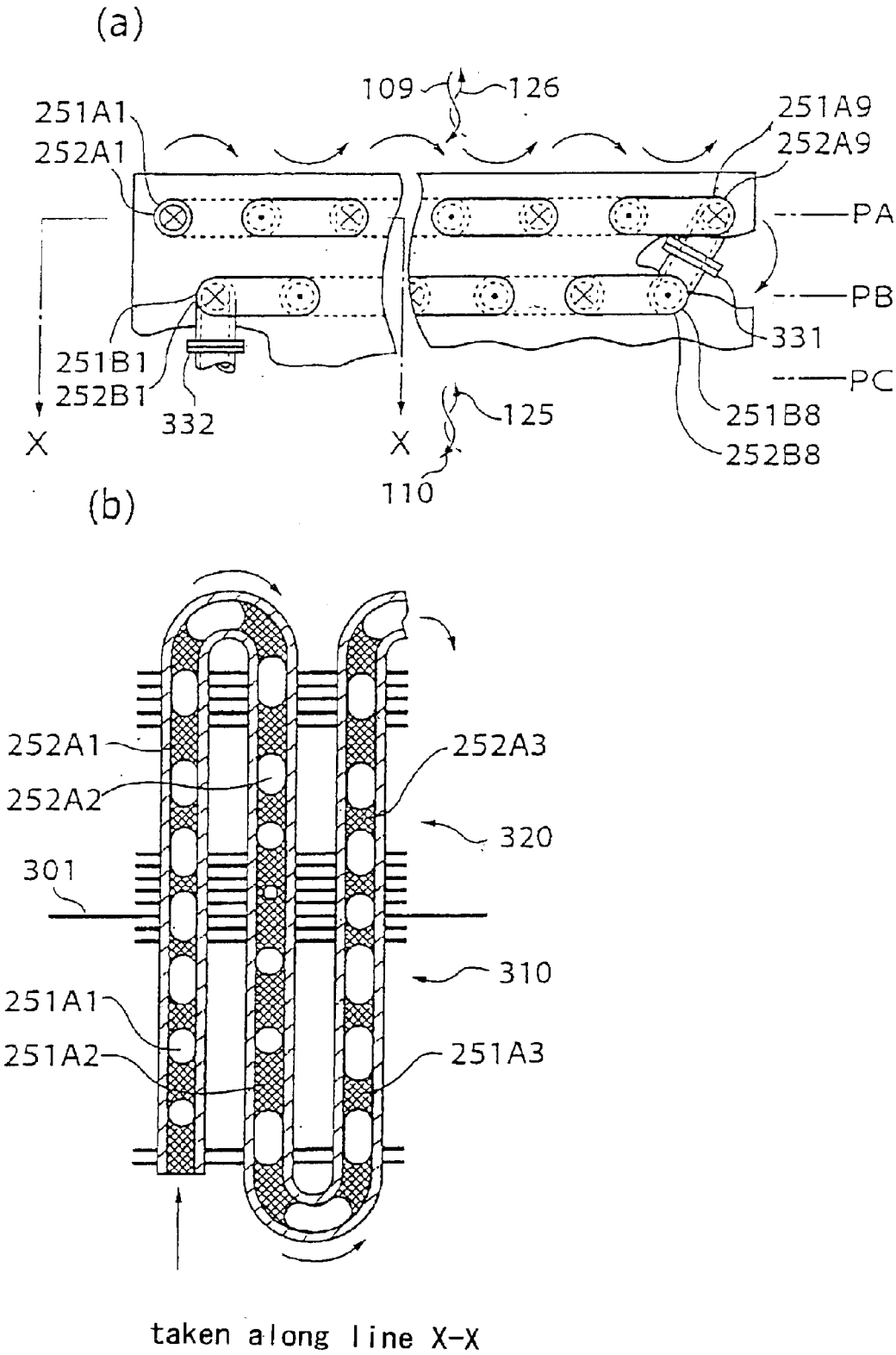
FIGS. 2(*a*) and 2(*b*) are schematic side elevational and cross-sectional plan views, respectively, of a heat exchanger suitable for use in the heat pump shown in FIG. 1.
Figure 3:
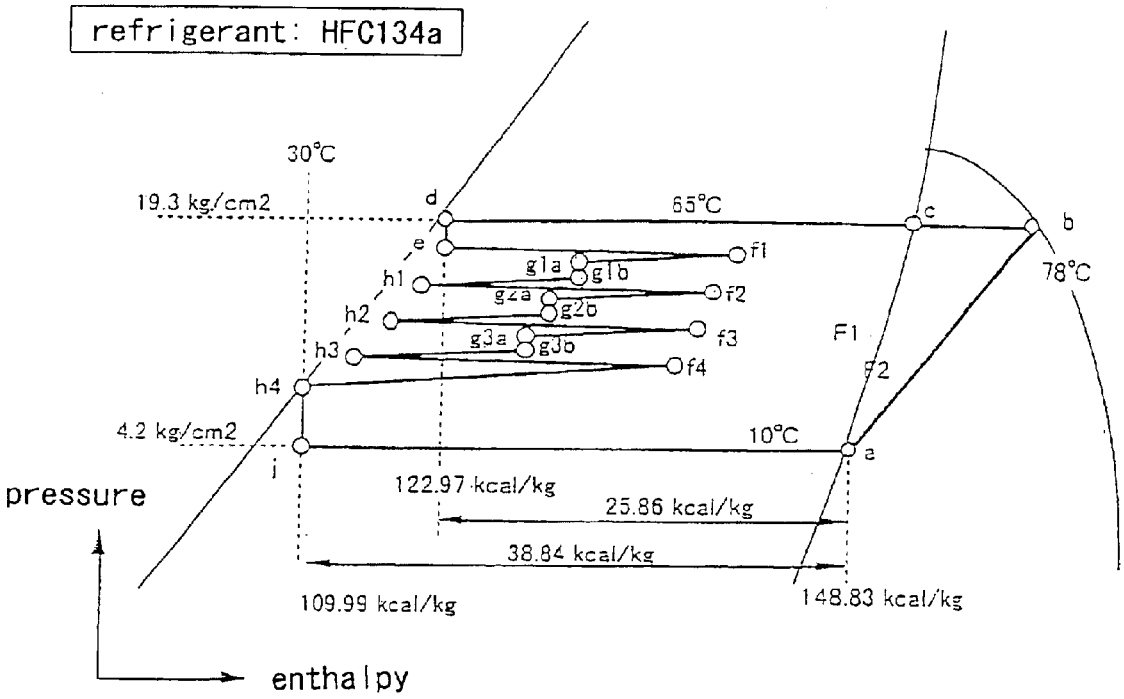
FIG. 3 is a Mollier diagram of the heat pump shown in FIG. 1.
Figure 4:
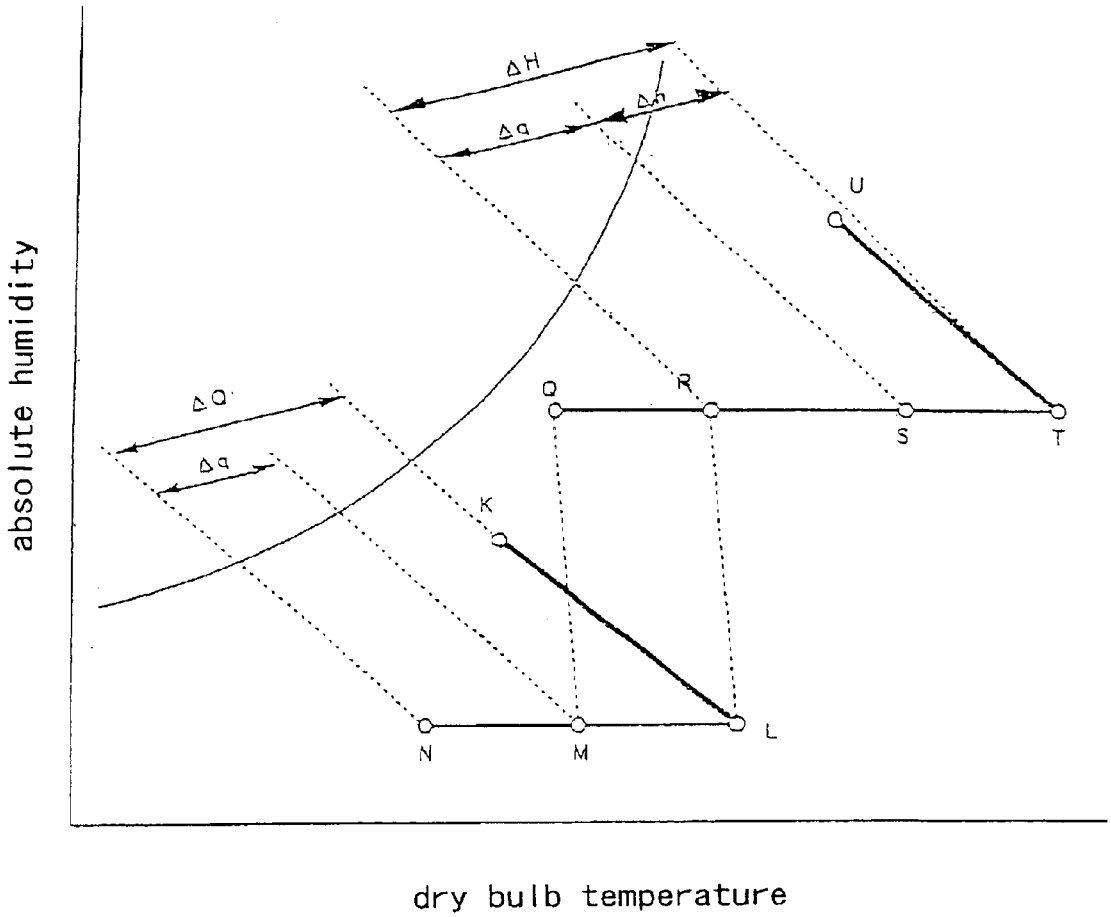
FIG. 4 is a psychrometric chart illustrative of operation of the dehumidifying air-conditioning apparatus shown in FIG. 1.

FIG. 1 is a flow diagram of a heat pump HP1 according to a first embodiment of the present invention and a dehumidifying air-conditioning apparatus having the heat pump HP1. The dehumidifying air-conditioning apparatus is an air-conditioning apparatus which employs a desiccant. FIGS. 2(*a*) and 2(*b*) are schematic side elevational and partial cross-sectional plan views, respectively, showing an example of a structure of a first heat exchanger used in the air-conditioning apparatus shown in FIG. 1. FIG. 3 is a refrigerant Mollier diagram of a heat pump HP1 included in the air-conditioning apparatus shown in FIG. 1. FIG. 4 is a psychrometric chart of the air-conditioning apparatus shown in FIG. 1.

Structural details of the heat pump according to the first embodiment and the dehumidifying air-conditioning apparatus having the heat pump will be described below with reference to FIG. 1. The air-conditioning apparatus lowers the humidity of process air with a desiccant to maintain a comfortable environment in an air-conditioned space 101 supplied with the process air. In FIG. 1, devices related to the process air will be described along a path for the process air A from the air-conditioned space 101. A path 107 connected to the air-conditioned space 101, an air blower 102 connected to the path 107 for circulating the process air, a path 108, a desiccant wheel 103 filled with a desiccant, a path 109, a first compartment 310 in a first heat exchanger 300*a* according to the present invention, a path 110, a refrigerant evaporator (as a cooling unit from the viewpoint of the process air) 210, and a path 111 are arranged in the order named so as to return the process air to the air-conditioned space 101.

A path 124, an air blower 140 for circulating regeneration air, a path 125, a second compartment 320 of the heat exchanger 300*a* for exchanging heat between the regeneration air flowing into a desiccant wheel 103 and the process air flowing out of the desiccant wheel, a path 126, a refrigerant condenser (as a heating unit from the viewpoint of the regeneration air) 220, a path 127, the desiccant wheel 103, and a path 128 are successively arranged in the order named along a path for the regeneration air B from an outside space OA so as to discharge the regeneration air as an exhaust air EX into the outside space.

Devices of the heat pump HP1 will be described below along a path for the refrigerant from the refrigerant evaporator 210. In FIG. 1, the refrigerant evaporator 210, a path 207, a compressor 260 for compressing the refrigerant which has been evaporated into a vapor by the refrigerant evaporator 210, a path 201, the refrigerant condenser 220, a path 202, a restriction 330, the heat exchanger 300*a*, a path 204, a restriction 250, and a path 206 are arranged in the order named so as to return the refrigerant to the refrigerant evaporator 210. The heat pump HP1 is thus constructed.

The desiccant wheel 103 comprises a thick disk-shaped wheel which is rotatable about a rotational axis AX, and a desiccant is filled into the wheel with gaps for allowing a gas to pass therethrough. For example, the desiccant wheel 103 comprises a number of tubular dry elements bounded to each other so that their central axes extend parallel to the rotational axis AX. The wheel is arranged so as to rotate in one direction about the rotational axis AX and also to allow the process air A and the regeneration air B to flow into and out of the desiccant wheel 103 parallel to the rotational axis AX. Each of the dry elements is positioned so as to alternately contact the process air A and the regeneration air B according to rotation of the wheel 103. Generally, the desiccant wheel 103 is arranged so that the process air A and the regeneration air B flow as counterflows parallel to the rotational axis AX through respective substantially half areas of the circular desiccant wheel 103.

Since the air-conditioning apparatus is arranged so that the compression type heat pump HP1 simultaneously cools the process air of the desiccant air-conditioner and heats the regeneration air thereof, the compression type heat pump HP1 produces a cooling effect on the process air based on the drive energy applied from an external source to the compression type heat pump HP1, and the desiccant is regenerated with heat which is the sum of heat pumped from the process air by the heat pump action and the drive energy of the compression type heat pump HP1. Therefore, the drive energy applied from the external source can be used in multiple ways for high energy saving effects. The energy saving effects are further increased by the heat exchanger 300*a* for exchanging heat between the process air and the regeneration air.

Structural details of the heat exchanger 300*a* suitable for use in the heat pump HP1 will be described below with reference to FIGS. 2(*a*) and 2(*b*). FIG. 2(*a*) is a side elevational view showing a plate-fin-tube heat exchanger as viewed in the longitudinal direction of the tubes as refrigerant passages, with some plate fins being shown fragmentarily. The symbol "X" at the centers of circular cross sections of tubes indicates that the refrigerant flows from the viewer toward the sheet of FIG. 2(*a*), and the symbol "•" at the centers of circular cross sections of tubes indicates that the refrigerant flows toward the viewer from the sheet of FIG. 2(*a*). FIG. 2(*b*) is a cross-sectional view taken along a line X—X of FIG. 2(*a*). In FIG. 2(*b*), the heat exchanger 300*a* has a first compartment 310 for allowing the process air A to pass therethrough and a second compartment 320 for allowing outside air as the regeneration air to pass therethrough, and the first and second compartments 310, 320 are positioned adjacent to each other with a single partition wall 301 being interposed therebetween.

In FIG. 2(*a*), the process air A is supplied from the upper side through the path 109 to the first compartment 310 and discharged from the lower side of the first compartment 310 through the path 110. The regeneration air B is supplied from the lower side through the path 125 to the second compartment 320 and discharged from the upper side of the second compartment 320 through the path 126. As shown in FIG. 2(*a*), the heat exchanger 300 has a plurality of substantially parallel heat exchange tubes as refrigerant passages in each of a plurality of different planes PA, PB, PC, . . . which are substantially horizontal (i.e., perpendicular to the sheet of FIG. 2(*a*)).

As shown in FIG. 2(*b*), the plurality of heat exchange tubes extend through the first compartment 310, the second compartment 320, and the partition wall 301 which separates those compartments from each other. The heat exchange tubes disposed in the plane PA shown in FIG. 2(*a*) for example, have portions extending through the first compartment 310, as shown in FIG. 2(*b*), and such portions are referred to as an evaporating section 251 as a first refrigerant passage. The plurality of evaporating sections are denoted by the respective reference numerals 251A1, 251A2, 251A3, . . . 251A9 (in the illustrated example, nine tubes are disposed in the single plane PA). Hereinafter, these evaporating sections are denoted by the single reference numeral 251 in the case where it is not necessary to discuss a plurality of evaporating sections separately. The heat exchange tubes disposed in the plane PA also have portions extending through the second compartment 320, and such portions are referred to as a condensing section 252 as a second refrigerant passage. The plurality of condensing sections are denoted by the respective reference numerals 252A1, 252A2, 252A3, . . . 252A9. Hereinafter, these condensing sections are denoted by the single reference numeral 252 in the case where it is not necessary to discuss a plurality of condensing sections separately. The evaporating section 251A1 and the condensing section 252A1, 251A2 and 252A2, 251A3 and 252A3, . . . 251A9 and 252A9 serve as a pair of a first compartment extending portion and a second compartment extending portion, respectively, and constitute refrigerant passages.

Further, as shown in FIG. 2(*b*), the heat exchange tubes disposed in the plane PB have a plurality of portions extending through the first compartment 310, and such portions are referred to as evaporating sections 251B1, 251B2, 251B3, . . . 251B8 (in the illustrated example, eight tubes are disposed in the plane PB). The heat exchange tubes disposed in the plane PB also have portions extending through the second compartment 320, and such portions, which constitute a pair of refrigerant passages with the above evaporating sections, are referred to as condensing sections 252B1, 252B2, 252B3, . . . 252B8 as second refrigerant passages. Refrigerant passages are also provided in the plane PC as with the plane PB, which is not shown.

In the heat exchanger shown in FIGS. 2(*a*) and 2(*b*), the evaporating section 251A1 and the condensing section 252A1 are paired with each other and formed by a single tube as an integral passage. The evaporating sections 251A1, 251A3, . . . and the condensing sections 252A2, 252A3, . . . , and the evaporating sections 251B1, 251B2, 251B3, . . . and the condensing sections 252B1, 252B2, 252B3, . . . are similarly constructed. This feature, together with the fact that the first compartment 310 and the second compartment 320 are positioned adjacent to each other with the single partition wall 301 being interposed therebetween, is effective in making the heat exchanger 300*a* small and compact as a whole.

In the heat exchanger shown in FIGS. 2(*a*) and 2(*b*), the evaporating sections 251A, 251B, 251C are successively arranged in the order named from the upper side of FIG. 2(*a*), and the condensing sections 252A, 252B, 252C are also successively arranged in the order named from the upper side of FIG. 2(*a*). In the plane PA, the evaporating sections are arrayed in the order of 251A1–251A9 from the left to the right in FIG. 2(*a*), and the condensing sections are also arrayed in the order of 252A1–252A9 from the left to the right in FIG. 2(*a*).

As shown in FIG. 2(*b*), the end of the condensing section 252A1 (remote from the partition wall 301) and the end of the condensing section 252A2 (remote from the partition wall 301) are connected to each other by a U tube. The end of the evaporating section 251A2 and the end of the evaporating section 251A3 are similarly connected to each other by a U tube.

Therefore, the refrigerant flowing in one direction from the evaporating section 251A1 to the condensing section 252A1 as a whole is introduced into the condensing section 252A2 by the U tube, and then flows into the evaporating section 251A2, from which the refrigerant flows into the evaporating section 251A3 via the U tube. In this manner, the refrigerant passages including the evaporating sections and the condensing sections extend through the first compartment 310 and the second compartment 320, alternately and repetitively. In other words, the refrigerant passages are provided as a group of meandering thin pipes. A group of meandering thin pipes pass through the first compartment 310 and the second compartment 320, and are held in alternate contact with the process air and the regeneration air.

In FIG. 2(*a*), the right-hand end of the refrigerant passage in the plane PA, i.e., the end of the condensing section 252A9, and the right-hand end of the refrigerant passage in the plane PB, i.e., the end of the condensing section 252B8, are connected to each other via an orifice 331 which serves as a restriction. The left-hand end of the refrigerant passage in the plane PB, i.e., the end of the condensing section 252B1, and the left-hand end of the refrigerant passage in the plane PC, i.e., the end of the condensing section 252C1 (not shown) are connected to each other via an orifice 332 which serves as a restriction.

In FIG. 2(*a*), the process air A flows downwardly into the first compartment 310 through a duct 109, and then flows downwardly out of the first compartment 310. In FIG. 2(*a*), outside air used as the regeneration air B flows upwardly into the second compartment 320 through a duct 125, and then flows upwardly out of the second compartment 320.

With the heat exchanger thus constructed, the refrigerant introduced into the evaporating section 251A1 is partly evaporated in the evaporating section 251A1, and flows in a wet state into the condensing section 252A1. The refrigerant is reversed in direction by the U tube, and flows into the condensing section 252A2 where the refrigerant is condensed. The condensed refrigerant then flows into the evaporating section 251A2, where the refrigerant is partly evaporated, then reversed in direction by the U tube, and flows into the evaporating section 251A3. The refrigerant is thus alternately evaporated and condensed repeatedly until it reaches the condensing section 252A9 in the final row in the plane PA. The refrigerant is then depressurized by the restriction 331, and flows into the condensing section 252B8 in the plane PB.

Then, the refrigerant similarly passes alternately through the condensing sections and the evaporating sections in the plane PB while being condensed and evaporated repeatedly therein until the refrigerant reaches the final condensing section 252B1 in the plane PB. The refrigerant is then depressurized by the restriction 332, and flows into the condensing section 252C1 in the plane PC.

An evaporating pressure in the evaporating section 251A and a condensing pressure in the condensing section 252A, i.e., first intermediate pressures, or pressures in the evaporating sections 251B and the condensing sections 252B, i.e., second intermediate pressures, are determined by the temperature of the process air A and the temperature of the outside air used as the regeneration air B. Since the heat exchanger 300*a* shown in FIGS. 2(*a*) and 2(*b*) utilizes heat transfer by way of evaporation and condensation, the heat exchanger has an excellent rate of heat transfer. Further, since the heat exchanger has a very high efficiency of heat exchange as it performs a heat exchange on the counterflow principles. Since the refrigerant is forcibly caused to flow in substantially one direction as a whole in the refrigerant passages, from the evaporating section 251 to the condensing section 252 or from the condensing section 252 to the evaporating section 251, the efficiency of heat exchange between the process air and the regeneration air (outside air) is very high. The expression "the refrigerant flows in substantially one direction as a whole" means that the refrigerant flows in substantially one direction in the refrigerant passages when viewed as a whole even though the refrigerant may locally flow back due to turbulences or be vibrated in the flowing direction due to pressure waves produced by bubbles or instantaneous interruptions. In the present embodiment, the refrigerant is forced to flow in one direction under the pressure increased by the compressor 260.

When the high-temperature fluid is cooled, i.e., the heat exchanger is used for cooling the high-temperature fluid, the efficiency $\phi$ of heat exchange is defined by $$\phi=(TP1-TP2)/(TP1-TC1)$$

where the temperature of the high-temperature fluid at the inlet of the heat exchanger is represented by TP1, the temperature thereof at the outlet of the heat exchanger by T, the temperature of the low-temperature fluid at the inlet of the heat exchanger is represented by TC1, and the temperature thereof at the outlet of the heat exchanger by TC2.

When the low-temperature fluid is to be heated, i.e., when the heat exchanger is used to heat the low-temperature fluid, the efficiency $\phi$ of heat exchange is defined by $$\phi=(TC2-TC1)/(TP1-TC1)$$

The inner surface of the heat exchange tube used in the evaporating section 251 and the condensing section 252 should preferably comprise a high-performance heat-transfer surface by forming therein spiral grooves such as linear grooves like those grooves which are found in the inner surface of a barrel of a rifle. The refrigerant liquid flowing through the heat exchange tube usually flows so as to wet the inner surface thereof. The spiral grooves disturb the boundary layer of the flow of the refrigerant liquid, resulting in an increased rate of heat transfer.

The process air flows through the first compartment 310. The fins mounted on the outer surface of the heat exchange tube in the first compartment 310 should preferably be arranged in the form of louvers to disturb the flow of the fluid flowing through the first compartment 310. Similarly, the fins in the second compartment 320 should also preferably be arranged to disturb the flow of the fluid flowing through the second compartment 320. The fins should preferably be made of aluminum or copper or an alloy thereof.

First, flows of the refrigerant between the devices will be described below with reference to FIG. 1, and then operation of the heat pump HP1 will be described below with reference to FIG. 3.

In FIG. 1, a refrigerant vapor compressed by the refrigerant compressor 260 is introduced into the regeneration air heating unit (refrigerant condenser) 220 via the refrigerant vapor pipe 201 connected to the discharge port of the compressor. The refrigerant vapor compressed by the compressor 260 is increased in temperature by the heat of compression, and the heat of the refrigerant vapor heats the regeneration air. Heat is removed from the refrigerant vapor itself, and the refrigerant vapor is condensed.

The refrigerant condenser 220 has a refrigerant outlet connected by the refrigerant path 202 to the inlet of the evaporating section 251A1 in the heat exchanger 300*a*. The restriction 330 is disposed on the refrigerant path 202 near the inlet of the evaporating section 251A1.

In FIG. 1, only the evaporating section 251A1 and the condensing section 252A1 paired therewith are shown as being positioned between the restriction 330 and the restriction 331 of the heat exchanger 330*a*. Although the evaporating section 251A1 and the condensing section 252A1 are a minimum requirement, a plurality of evaporating sections and condensing sections are typically arranged in one plane, e.g., the plane PA, as described above with reference to FIGS. 2(*a*) and 2(*b*).

The refrigerant liquid that flows out of the refrigerant condenser (as a heating unit from the viewpoint of the regeneration air) 220 is depressurized by the restriction 330 and expanded so as to be partly evaporated (flashed). The refrigerant which is a mixture of the liquid and the vapor reaches the evaporating section 251A1, where the refrigerant liquid flows so as to wet the inner wall surface of the tube in the evaporating section 251A1 and is evaporated to cool the process air which flows through the first compartment 310.

The evaporating section 251A1 and the condensing section 252A1 are constructed as a continuous tube. Specifically, since the evaporating section 251A1 and the condensing section 252A1 are provided as an integral passage, the evaporated refrigerant vapor (and the refrigerant liquid which has not been evaporated) flows into the condensing section 252A2. In this time, heat is removed from the refrigerant vapor by the outside air flowing through the second compartment 320, and the refrigerant vapor is condensed.

As described above, the heat exchanger 300*a* has the evaporating section as the refrigerant passage extending through the first compartment 310 and the condensing section as the refrigerant passage extending through the second compartment 320 (at least one pair of them, e.g., denoted by 251A9 and 252A9) in the first plane PA, and also has the condensing section as the refrigerant passage extending through the second compartment 320 and the evaporating section as the refrigerant passage extending through the first compartment 310 (at least one pair of them, e.g., denoted by 252B8 and 251B8) in the second plane PB. The heat exchanger 300*a* has the intermediate restriction 331 in a transitional location position where the refrigerant moves from the condensing section 252A9 in the plane PA to the condensing section 252B8 in the plane PB. Specifically, the intermediate restriction 331 is located in a position where the refrigerant passage has extended through the second compartment 320.

In the first embodiment, the heat pump HP1 has intermediate restrictions 331, 332, 333 which interconnect condensing sections in the different planes, and a plurality of pairs of condensing sections and evaporating sections which are disposed downstream of the restriction 333. Thus, the heat pump HP1 is arranged such that the refrigerant in the liquid phase flows out of the heat exchanger 300*a* finally through the condensing section.

The final condensing section of the heat exchanger 300*a* has its outlet connected to an expansion valve 250 as a second restriction via the refrigerant liquid pipe 204. The expansion valve 250 is connected to the refrigerant evaporator (as a cooling unit from the viewpoint of the process air) 210 via the refrigerant pipe 206.

The restriction 250 may be positioned at any position from the condensing section to the inlet of the refrigerant evaporator 210, but should preferably be positioned just in front of the inlet of the refrigerant evaporator 210. It is because a heat insulating material of the refrigerant pipe needs to be thickened as temperature of the refrigerant flowing out of the restriction 250 is considerably lower than the atmospheric temperature. The refrigerant liquid condensed in the condensing section is depressurized by the restriction 250, and expanded and lowered in temperature. The refrigerant is then introduced into the refrigerant evaporator 210 where the refrigerant is evaporated to cool the process air with heat of evaporation. The restrictions 330, 250 may comprise orifices, capillary tubes, expansion valves, or the like. The intermediate restrictions 331, 332, 333 usually comprise orifices.

The refrigerant which has been evaporated into a vapor in the refrigerant evaporator 210 is introduced into the suction side of the refrigerant compressor 260, and thus the above cycle is repeated.

The behavior of the refrigerant in the evaporating sections and the condensing sections of the heat exchanger 300*a* will be described below with reference to FIG. 2(*b*). The refrigerant flows into the evaporating section 251A1 in the liquid phase. The refrigerant may be a refrigerant liquid which has been partly evaporated to slightly contain a vapor phase. While the refrigerant liquid is flowing through the evaporating section 251A1, it is heated by the process air and enters the condensing section 252A1 while increasing the vapor phase thereof. In the condensing section 252A1, the refrigerant heats the regeneration air. In this time, heat is removed from the refrigerant itself, and while the refrigerant in the vapor phase is being condensed, the refrigerant flows into the next condensing section 252A2. While the refrigerant is flowing through the condensing section 252A2, heat is further removed from the refrigerant by the regeneration air, and the refrigerant in the vapor phase is further condensed. Thereafter, the refrigerant flows into the next evaporating section 251A2. In this manner, the refrigerant flows through the refrigerant passages while changing in phase between the vapor phase and the liquid phase. Thus, heat is exchanged between the process air as a low-temperature heat source fluid in the heat pump HP1 and the regeneration air as a high-temperature heat source fluid in the heat pump HP1.

Next, operation of the heat pump HP1 will be described below with reference to FIG. 3. FIG. 3 is a Mollier diagram in the case where HFC134a is used as the refrigerant. In the Mollier diagram, the horizontal axis represents the enthalpy, and the vertical axis represents the pressure.

For illustrative purposes, it is assumed that the refrigerant passage is constituted by a pair of the evaporating section 251A1 and the condensing section 252A1 in the plane PA, the restriction 331, the condensing section 252B2 and the evaporating section 251B2, and the evaporating section 251B1 and the condensing section 252B1 in the plane PB, the restriction 332, the condensing section 252C1 and the evaporating section 251C1, and the evaporating section 251C2 and the condensing section 252C2 in the plane PC, the restriction 333, the condensing section 252D2 and the evaporating section 251D2, and the evaporating section 251D1 and the condensing section 252D1 in the plane PD, and reaches the restriction 250.

In FIG. 3, a point "a" represents a state of the refrigerant at the outlet port of the refrigerant evaporator 210, and the refrigerant is in the form of a saturated vapor. The refrigerant has a pressure of 4.2 kg/cm$^2$, a temperature of 10° C., and an enthalpy of 148.83 kcal/kg. A point b represents a state of the vapor drawn and compressed by the compressor 260, i.e., a state at the outlet port of the compressor 260. In the point b, the refrigerant has a pressure of 19.3 kg/cm$^2$ and a temperature of 78° C., and is in the form of a superheated vapor.

The refrigerant vapor is cooled in the refrigerant condenser 220 and reaches a state represented by a point c in the Mollier diagram. In the point c, the refrigerant is in the form of a saturated vapor and has a pressure of 19.3 kg/cm$^2$ and a temperature of 65° C. Under this pressure, the refrigerant is further cooled and condensed to reach a state represented by a point d. In the point d, the refrigerant is in the form of a saturated liquid and has the same pressure and temperature as those in the point c. The saturated liquid has an enthalpy of 122.97 kcal/kg.

The refrigerant liquid is depressurized by the restriction 330 and flows into the evaporating section 251A1 in the heat exchanger 300*a*. This state is indicated at a point e on the Mollier diagram. The temperature of the refrigerant liquid is slightly higher than the temperature of the outside air. The pressure of the refrigerant liquid is a first intermediate pressure according to the present invention, i.e., is of an intermediate value between 4.2 kg/cm$^2$ and 19.3 kg/cm$^2$ in the present embodiment. The refrigerant liquid is a mixture of the liquid and the vapor because part of the liquid is evaporated.

In the evaporating section 251A1, the refrigerant liquid is evaporated under the first intermediate pressure, and reaches a state represented by a point f1, which is located intermediately between the saturated liquid curve and the saturated vapor curve, under the intermediate pressure. In the point f1, while part of the liquid is evaporated, the refrigerant liquid remains in a considerable amount.

The refrigerant in the state represented by the point f1 flows into the condensing section 252A1. In the condensing section 252A1, heat is removed from the refrigerant by the outside air which flows through the second compartment 320, and the refrigerant reaches a state represented by a point g1a.

The refrigerant in the state at the point g1a is depressurized by the restriction 331, and reaches a state represented by a point g1b. In the point g1b, the refrigerant has a second intermediate pressure which is lower than the pressure at the point g1a. Then, heat is removed from the refrigerant in the condensing section 252B2, and the refrigerant reaches a state represented by a point h1 while increasing its liquid phase. Then, the refrigerant flows into the evaporating section 251B2, where the refrigerant increases its vapor phase and reaches a state represented by a point f2. Thereafter, the refrigerant flows into the condensing section 252B1. In the condensing section 252B1, heat is removed from the refrigerant by the outside air flowing through the second compartment 320, and reaches a state represented by a point g2a.

The refrigerant in the state at the point g2a is depressurized by the restriction 332, and reaches a state represented by a point g2b. In the point g2b, the refrigerant has a third intermediate pressure which is lower than the pressure at the point g2a. Then, heat is removed from the refrigerant in the condensing section 252C2, and the refrigerant reaches a state represented by a point h2 while increasing its liquid phase. Thereafter, the refrigerant flows into the evaporating section 251C2.

The refrigerant is depressurized by the intermediate restriction 333, then flows through the refrigerant passages in the condensing section, the evaporating section, the evaporating section, and the condensing section, and reaches a state represented by a point h4 on the Mollier diagram. On the Mollier diagram, the point h4 is on the saturated liquid curve. In this point, the refrigerant has a temperature of 30° C. and an enthalpy of 109.99 kcal/kg.

The refrigerant liquid at the point h4 is depressurized to 4.2 kg/cm$^2$, which is a saturated pressure at a temperature of 10° C., by the restriction 250. The refrigerant flows as a mixture of the refrigerant liquid and the vapor at a temperature of 10° C. into the refrigerant evaporator 210, where the refrigerant removes heat from the process air and is evaporated into a saturated vapor at the state represented by the point a on the Mollier diagram. The evaporated vapor is drawn again by the compressor 260, and thus the above cycle is repeated.

In the heat exchanger 300*a*, as described above, the refrigerant goes through changes of the evaporated state from the point e to the point f1 or from the point h1 to the point f2 in the evaporating section 251, and goes through changes of the condensed state from the point f1 to the point g1a or from the point g1b to the point h1 in the condensing section 252. Since the refrigerant transfers heat by way of evaporation and condensation, the rate of heat transfer is very high.

In the compression type heat pump HP1 including the compressor 260, the refrigerant condenser (regeneration air heating unit) 220, the restrictions 330, 250, and the refrigerant evaporator 210, when the heat exchanger 300*a* is not provided, the refrigerant at the state represented by the point d in the refrigerant condenser 220 is returned to the refrigerant evaporator 210 through the restrictions. Therefore, the enthalpy difference that can be used by the refrigerant evaporator 210 is only 148.83−122.97=25.86 kcal/kg. With the heat pump HP1 according to the present embodiment which has the heat exchanger 300*a*, however, the enthalpy difference that can be used by the refrigerant evaporator 210 is 148.83−109.99=38.84 kcal/kg. Thus, the amount of vapor that is circulated to the compressor under the same cooling load and the required power can be reduced by 33%. Consequently, the heat pump HP1 according to the present embodiment can perform the same operation as with a well-known subcooled cycle.

Operation of the dehumidifying air-conditioning apparatus having the heat pump HP1 will be described below with reference to FIG. 4. FIG. 1 will be referred to for structural details. In FIG. 4, the alphabetical letters K–N and Q–U represent states of air in various regions, and correspond to the encircled letters in the flow diagram shown in FIG. 1. The psychrometric chart shown in FIG. 4 is also applicable to a dehumidifying air-conditioning apparatus according to another embodiment of the present invention which will be described later on.

First, the flow of the process air A will be described below. In FIG. 4, the process air (in a state K) from the air-conditioned space 101 is drawn via the process air path 107 into the air blower 102, and delivered via the process air path 108 into the desiccant wheel 103. The moisture of the process air is adsorbed by the desiccant in the dry elements of the desiccant wheel 103. The absolute humidify of the process air is reduced, and the dry-bulb temperature thereof is increased by heat of adsorption by the desiccant, so that the process air reaches a state L. The process air flows through the process air path 109 into the first compartment 310 in the heat exchanger 300*a*, where the process air is cooled, with the constant absolute humidity, by the refrigerant evaporated in the evaporating section 251 (FIG. 2). The process air then reaches a state M, and flows via the path 110 into the cooling unit 210. In the cooling unit 210, the process air is further cooled, with constant absolute humidity, and reaches a state N. The process air is then dried and cooled, and returned as process air SA having a suitable humidity and a suitable temperature via the duct 111 into the air-conditioned space 101.

The flow of the regeneration air B will be described below. The regeneration air B (in a state Q) from the outside space OA is drawn via the regeneration air path 124, and flows via the path 125 into the second compartment 320 of the heat exchanger 300*a*. In the second compartment 320, the regeneration air exchanges heat with the process air (in a state L) flowing through the second compartment 310 indirectly through the refrigerant which flows through the evaporating section 251 and the condensing section 252 as the refrigerant passage in the heat exchanger 300*a*. As a result of the heat exchange, the regeneration air is increased in dry-bulb temperature and reaches a state R. The regeneration air is then delivered via the path 126 into the refrigerant condenser (as a heating unit from the viewpoint of the regeneration air) 220, where the regeneration air is heated and increased in dry-bulb temperature to reach a state T. The regeneration air is then delivered via the path 127 into the desiccant wheel 103, where moisture is removed (desorbed) from the desiccant in the dry elements, so that the desiccant is regenerated. The regeneration air is increased in absolute humidity and lowered in dry-bulb temperature due to heat of desorption of the moisture from the desiccant, and reaches a state U. As described above, the regeneration air is then discharged through the path 128 as the exhaust air EX.

From an air cycle in the psychrometric chart shown in FIG. 4, it can be shown that, in the air-conditioning apparatus described above, the amount of heat H applied to the regeneration air to regenerate the desiccant, the amount of heat q pumped from the process air, and the drive energy h of the compressor are related to each other by H=q+h.

Figure 5:
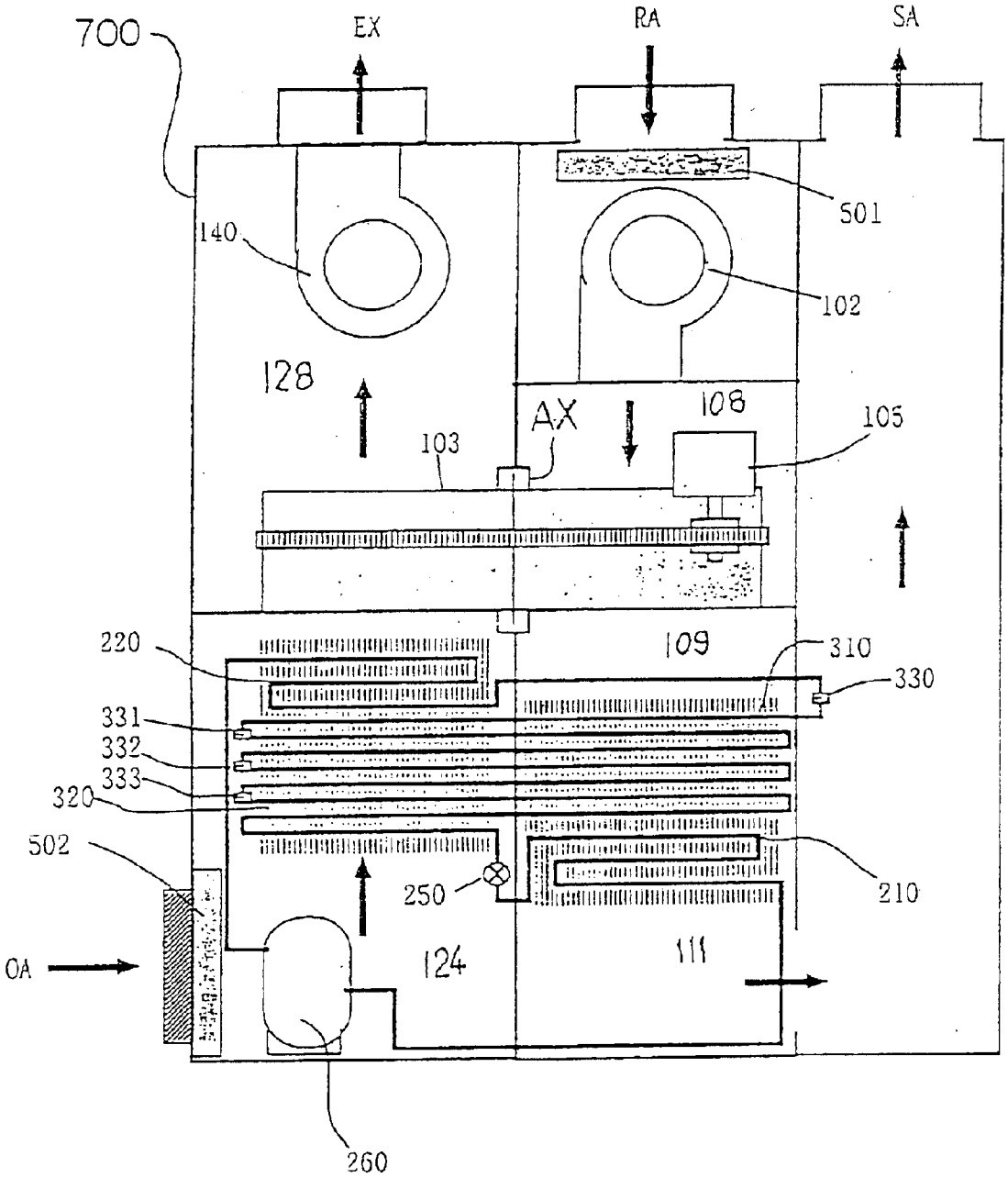
FIG. 5 is a cross-sectional front elevational view schematically showing an example of an actual structure of a dehumidifying air-conditioning apparatus having a heat pump according to the first embodiment of the present invention.

A mechanical arrangement of the dehumidifying air-conditioning apparatus described above will be described below with reference to FIG. 5. In FIG. 5, devices of the dehumidifying air-conditioning apparatus are housed in a cabinet 700. The cabinet 700 comprises a housing made of thin steel sheets in the form of a rectangular parallelepiped, for example, and has an inlet port for process air RA which is opened in the center of a vertically upper ceiling panel thereof. A filter 501 is provided at the inlet port for preventing dusts in the air-conditioned space from entering the dehumidifying air-conditioning apparatus. The air blower 102 is disposed inwardly of the filter 501 in the cabinet 700, and has its inlet port communicating with the process air inlet port of the cabinet through the filter 501.

The air blower 102 has an outlet port directed vertically downwardly, and the desiccant wheel 103 is disposed below the air blower 102 with the rotational axis AX being vertically oriented. The desiccant wheel 103 is operatively coupled through a belt, a chain, or the like to an electric motor 105 as an actuator with its rotatable shaft being vertically oriented, and can be rotated at a low speed of about one revolution per several minutes. Since the desiccant wheel 103 is rotatable in a substantially horizontal plane about the vertical rotational axis AX, the dehumidifying air-conditioning apparatus is compact with its height reduced.

The outlet port of the air blower 102 is connected to the desiccant wheel via a passage 108. The passage 108 is divided from the other parts by thin steel sheets which are similar to those of the cabinet 700, for example. The process air flows into about one half (semicircular region) of the circular desiccant wheel 103.

The first compartment 310 of the heat exchanger 300*a*, i.e., the evaporating section 251, is disposed downwardly below one half (semicircular region) of the desiccant wheel 103 through which the process air flows. The desiccant wheel 103 and the first compartment 310 are connected to each other by a path 109 defined as a space between the desiccant wheel 103 horizontally disposed and tubes horizontally disposed (and fins mounted thereon) of the evaporating section in FIG. 7.

Figure 7:
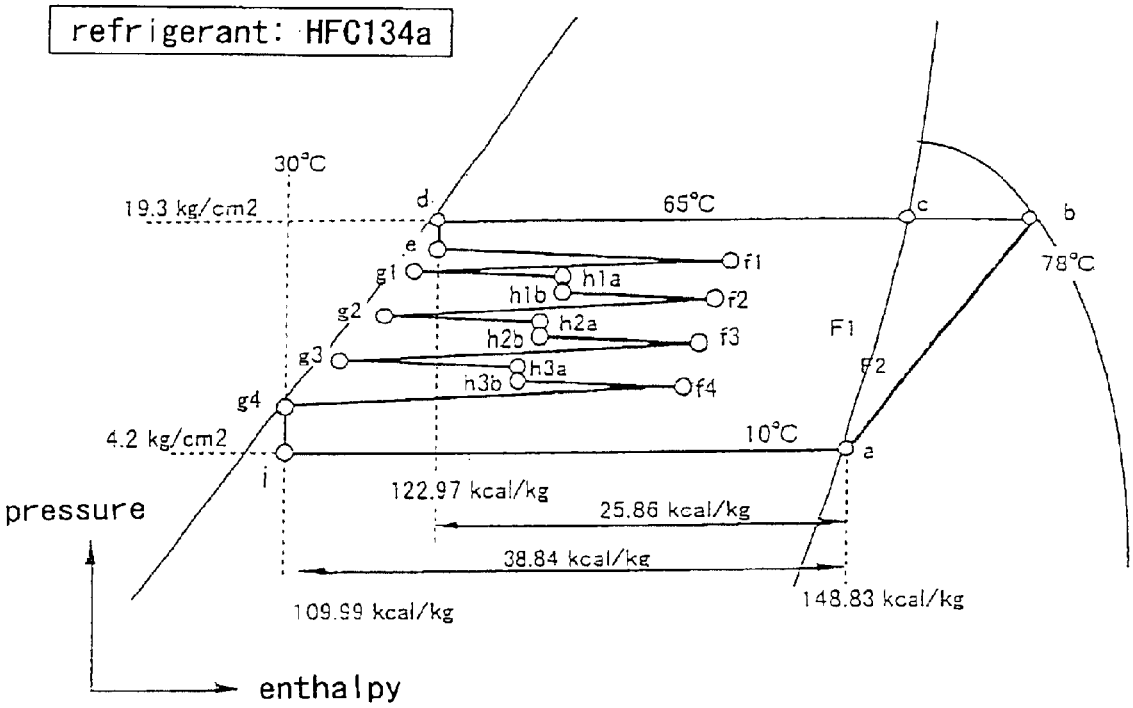
FIG. 7 is a Mollier diagram of the heat pump shown in FIG. 6.

The refrigerant evaporator 210 with horizontal cooling pipes is disposed downwardly below the first compartment 310. In FIG. 7, a path 110 is defined as a space between the first compartment 310 and the refrigerant evaporator 210. Since the first compartment 310 and the refrigerant evaporator 210 are integrally combined with each other, the space therebetween is joined to the heat exchanger 300*a* and the refrigerant evaporator 210. Vertically below the refrigerant evaporator 210, there is disposed a starting portion of a path 111 extending horizontally on the bottom of the cabinet 700. The path 111 changes its direction and is directed upwardly and isolated from the paths 109, 108 by partition walls, and finally reaches the ceiling panel of the cabinet 700, i.e., an air supply port SA which is opened alongside of the inlet port for the process air RA.

An inlet port for introducing outside air OA is opened in a lower side panel of the cabinet 700, and a filter 502 is provided at the inlet port for blocking dust carried by the outside air. A space defined inwardly of the filter 502 serves as a path 124, in which the compressor 260 is installed. While the air blower 140 is disposed between the outside air inlet port and the heat exchanger 300*a* in FIG. 1, the air blower 140 is disposed between the desiccant wheel 103 and a regeneration air outlet port in FIG. 5 as described later on. The air blower 140 may be placed in any of these positions as long as it can circulate the regeneration air.

The second compartment 320 of the heat exchanger 300*a* is disposed vertically above the compressor 260. The condenser 220 is disposed above the second compartment 320 of the heat exchanger 300*a*. In this example, the second compartment 320 of the heat exchanger 300*a* and the condenser 220 have common fins and are integrally constructed. The intermediate restrictions 331, 332, 333 are mounted on the ends of the condensing sections that extend through the second compartment 320 and arranged along the cabinet 700.

About one half (semicircular region) of the circular desiccant wheel 103 through which the regeneration air flows is disposed vertically above the condenser 220.

The space vertically above the latter half region of the desiccant wheel 103 serves as a path 128 where the air blower 140 is located. The air blower 140 has an outlet port disposed at the ceiling panel of the cabinet 700 adjacent to the process air inlet port. The outlet port of the air blower 140 serves as a port for discharging the used regeneration air into the outside space.

Since the heat exchanger 300*a* utilizes heat transfer by way of evaporation and condensation and exchanges heat between the process air and the regeneration air substantially on the counterflow principle, the heat pump HP1 and hence the dehumidifying air-conditioning apparatus can be arranged in a compact size.

Figure 6:
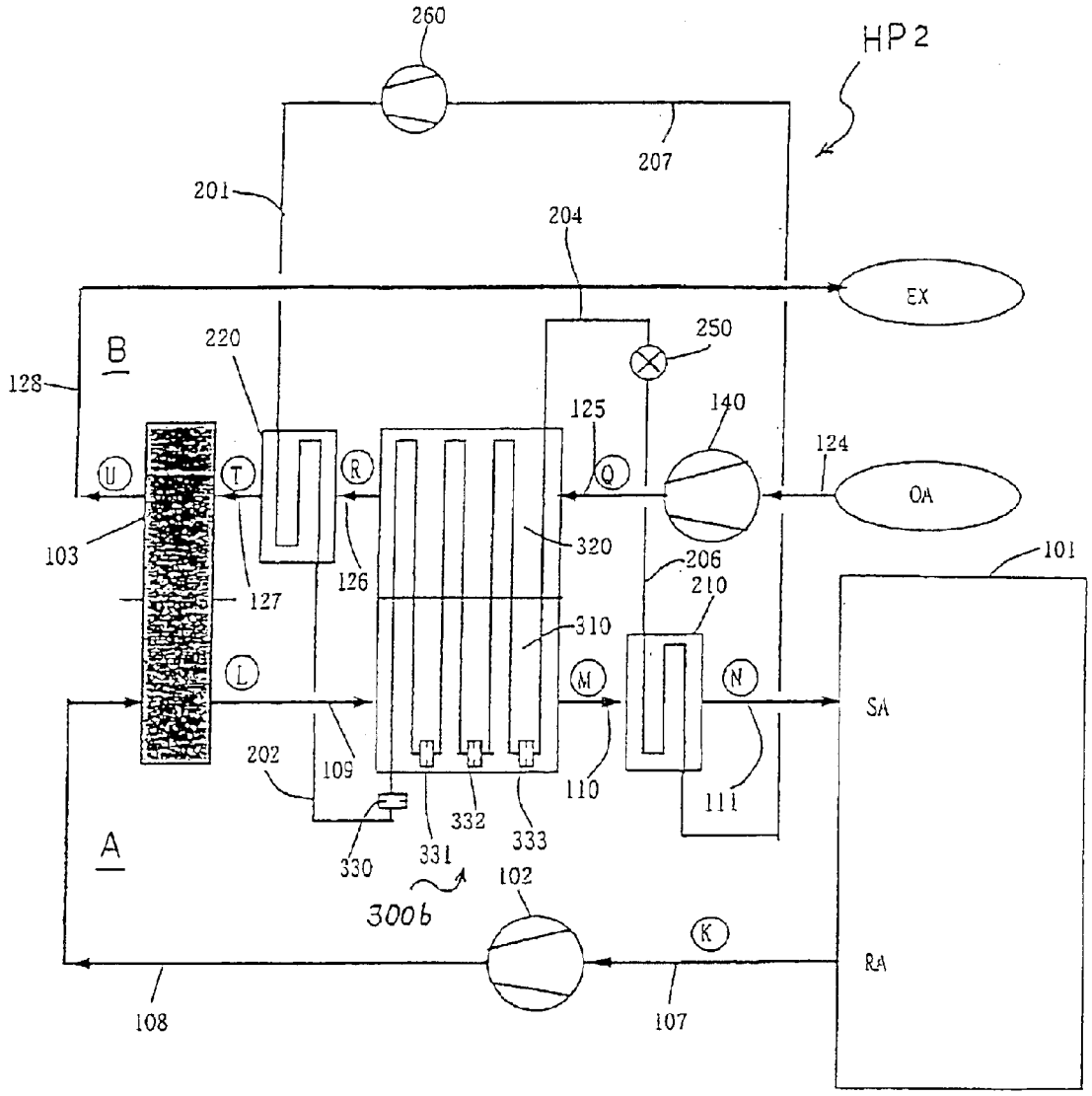
FIG. 6 is a flow diagram of a heat pump according to a second embodiment of the present invention and a dehumidifying air-conditioning apparatus having the heat pump.

Structural details of a heat pump HP2 according to a second embodiment and the dehumidifying air-conditioning apparatus incorporating the heat pump will be described below with reference to FIG. 6. A heat exchanger 300*b* is the same as the heat exchanger according to the first embodiment except that the intermediate restrictions 331, 332, 333 are disposed in the evaporating section.

Specifically, the heat exchanger 300*b* has the condensing section as the refrigerant passage extending through the second compartment 320 and the evaporating section as the refrigerant passage extending through the first compartment 310 (at least one pair of them, e.g., denoted by 252A1 and 251A1) in the first plane PA, and also has the evaporating section as the refrigerant passage extending through the first compartment 310 and the condensing section as the refrigerant passage extending through the second compartment 320 (at least one pair of them, e.g., denoted by 251B1 and 252B1) in the second plane PB. The heat exchanger 300*a* has the intermediate restriction 331 in a transitional location where the refrigerant moves from the evaporating section 251A1 in the plane PA to the evaporating section 251B1 in the plane PB. Specifically, the intermediate restriction 331 is located in a position where the refrigerant passage has extended through the first compartment 310.

As with the heat exchanger 300*a*, in the heat exchanger 300*b*, the refrigerant circulating in a heat pump cycle is utilized, typically in the total amount thereof, for repeatedly exchanging heat alternately through pairs of evaporating and condensing sections which are connected in series. Therefore, heat can sufficiently be exchanged between the process air and the regeneration air when a small fraction of the flowing refrigerant is evaporated and condensed. Usually, in the evaporating section, the refrigerant liquid remains unevaporated in a considerable amount. Consequently, even through the intermediate restrictions

331, 332, 333 are disposed in the evaporating section, necessary pressure differences can be developed in the refrigerant passage in the respective planes (PA, PB, PC, . . . ).

Operation of the heat pump HP2 according to the second embodiment will be described below with reference to FIG. 7. In FIG. 7, the transitions from the point "a" to the point e are identical to those shown in FIG. 3 and will not be described below. The refrigerant in the state represented by the point e which flows into an evaporating section 251A1 in the heat exchanger 300*b* is a mixture of the liquid and the vapor with part of the liquid being evaporated under the first intermediate pressure, as described above with reference to FIG. 3.

The refrigerant is further evaporated in the evaporating section, and reaches a point f1 nearer to the saturated vapor curve in the wet region on the Mollier diagram. The refrigerant in this state flows into the condensing section, where the refrigerant is condensed. Then, refrigerant reaches a point g1 nearer to the saturated liquid curve though in the wet region. Then, the refrigerant flows into the evaporating section, goes toward the saturated vapor curve within the wet region to reach a point h1a. Up to this point, the refrigerant undergoes changes substantially under the first intermediate pressure.

The refrigerant in the state indicated by the point h1a is depressurized by the restriction 331, and reaches a point h1b under the second intermediate pressure. Specifically, the refrigerant flows from the evaporating sections as the refrigerant passages in the plane PA into the evaporating sections as the refrigerant passages in the plane PB. This refrigerant is evaporated under the second intermediate pressure in the evaporating section, and reaches a point f2. The refrigerant is then repeatedly similarly evaporated and condensed alternately, and depressurized by the intermediate restriction 333. Thereafter, the refrigerant flows through the evaporating and condensing sections, and reaches a point g4 on the Mollier diagram which corresponds to the point h4 in FIG. 3. On the Mollier diagram, the point g4 is on the saturated liquid curve. In this point, the refrigerant has a temperature of 30° C. and an enthalpy of 109.99 kcal/kg.

As in the case of FIG. 3, the refrigerant liquid at the point g4 is depressurized to 4.2 kg/cm$^2$, which is a saturated pressure at a temperature of 10° C., by the restriction 250. The refrigerant flows as a mixture of the refrigerant liquid and the vapor at a temperature of 10° C. into the refrigerant evaporator 210, where the refrigerant removes heat from the process air and is evaporated into a saturated vapor at the state indicated by the point a on the Mollier diagram. The evaporated vapor is drawn again by the compressor 260, and thus the above cycle is repeated.

In the heat exchanger 300*b*, as described above, the refrigerant repeatedly goes alternately through changes of vapor phase and changes of liquid phase. Since the refrigerant transfers heat by way of evaporation and condensation, the rate of heat transfer is very high, as with the heat exchanger 300*a*.

The enthalpy difference that can be used by the refrigerant evaporator 210 is remarkably larger than that in the conventional heat pump. Thus, the amount of vapor that is circulated to the compressor under the same cooling load and the required power can be reduced by 33%, as in the case of FIG. 3.

Operation of the dehumidifying air-conditioning apparatus with the heat pump HP2 will not be described below as it is qualitatively the same as described above with reference to the psychrometric chart of FIG. 4.

Figure 8:
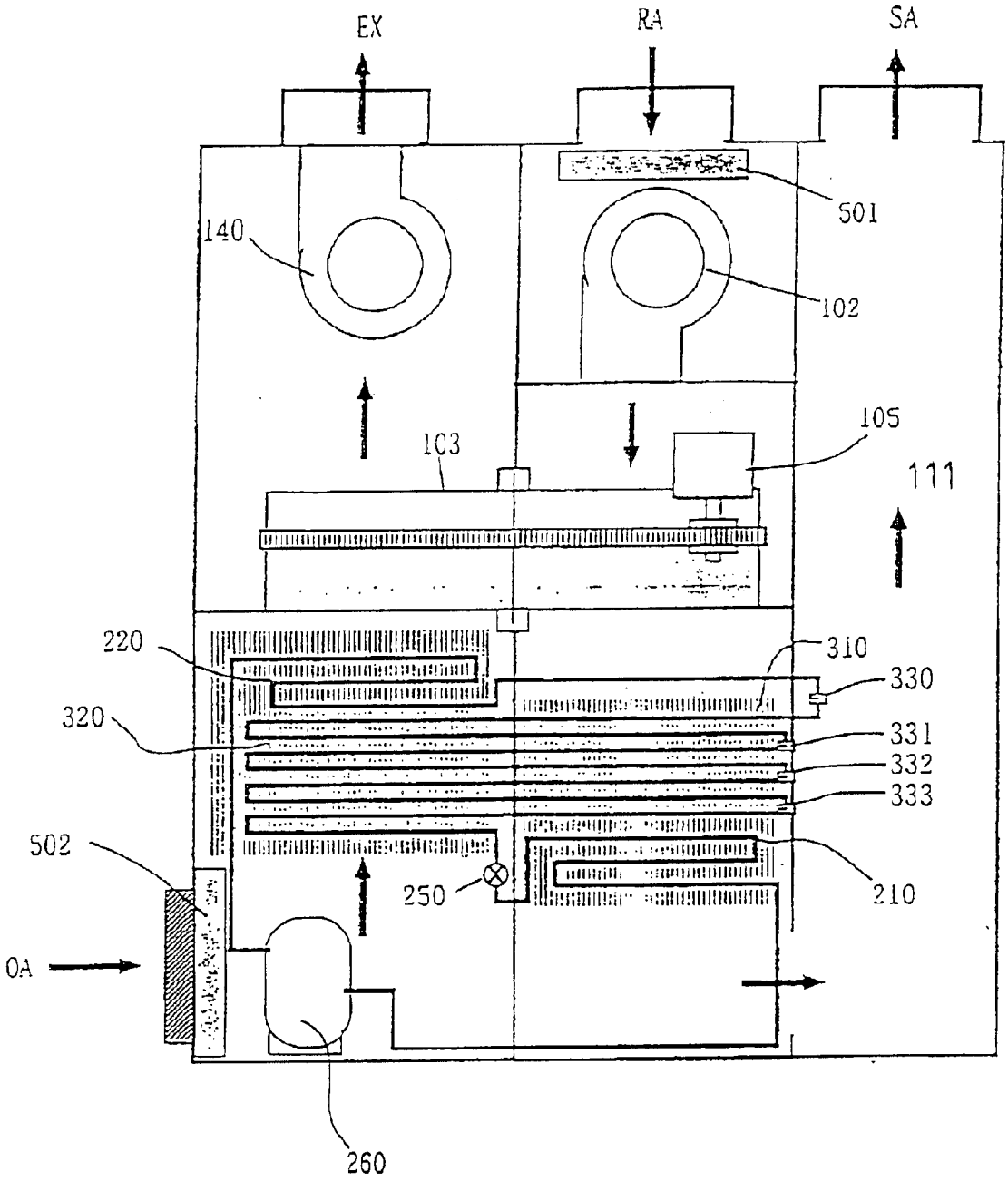
FIG. 8 is a cross-sectional front elevational view schematically showing an example of an actual structure of a dehumidifying air-conditioning apparatus having a heat pump according to the second embodiment of the present invention.

FIG. 8 shows a mechanical arrangement of a heat pump HP2 according to the second embodiment of the present invention and a dehumidifying air-conditioning apparatus having the heat pump HP2. In the present embodiment, the intermediate restrictions 331, 332, 333 are mounted on the ends of the evaporating sections that extend through the first compartment 310 and arranged along a partition wall which defines the vertically upward portion of the process air path 111. Other mechanical details of the present embodiment are identical to those shown in FIG. 5.

Figure 9:
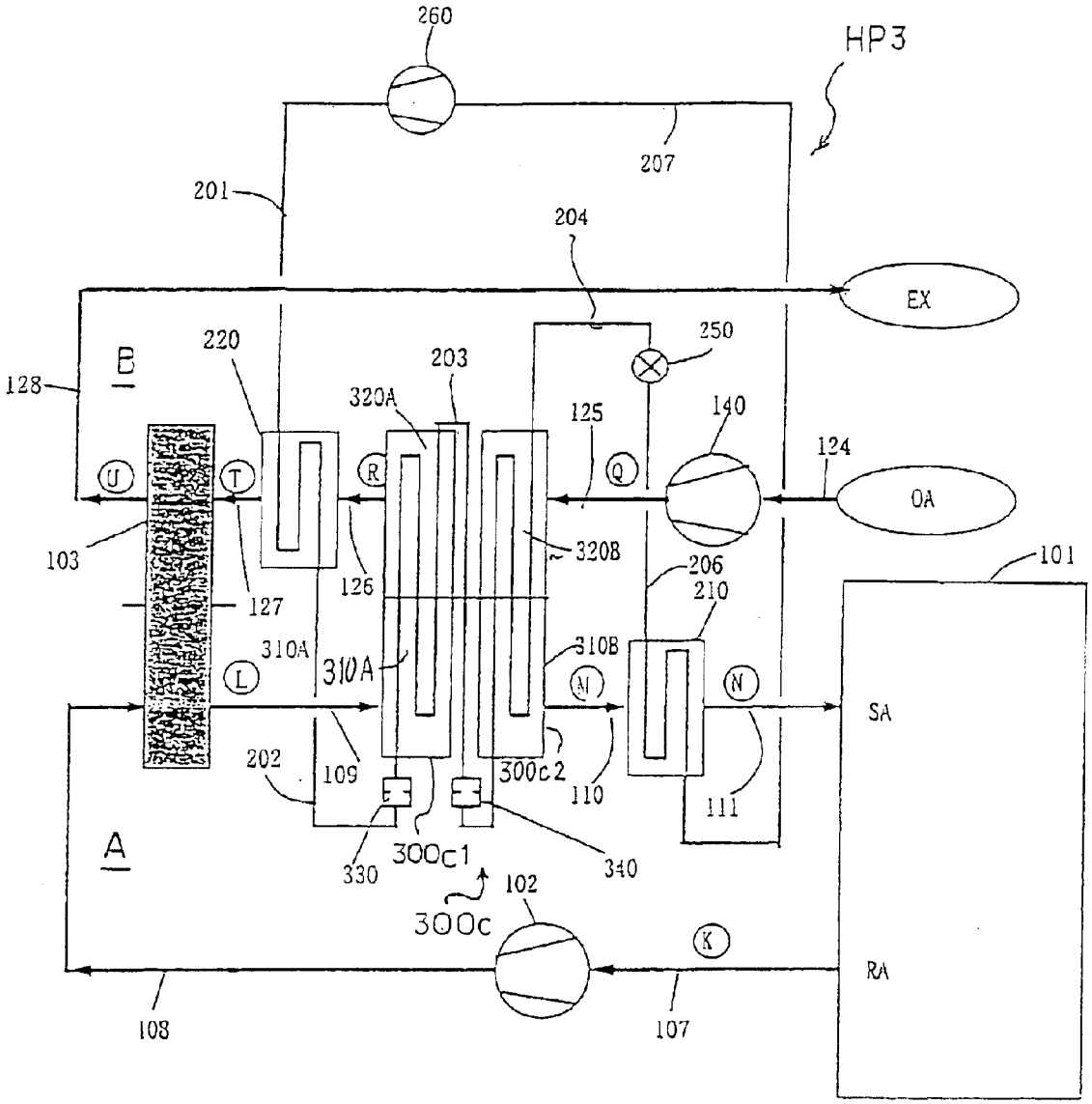
FIG. 9 is a flow diagram of a heat pump according to a third embodiment of the present invention and a dehumidifying air-conditioning apparatus having the heat pump.

A heat pump HP3 according to a third embodiment of the present invention and a dehumidifying air-conditioning apparatus incorporating the heat pump HP3 will be described below with reference to FIG. 9. In the present embodiment, a heat exchanger 300*c* for exchanging heat between the process air flowing out of the desiccant wheel 103 and the regeneration air flowing into the condenser 220 is divided into a heat exchanger 300*c*1 which is located upstream with respect to the flow of the process air and a heat exchanger 300*c*2 which is located downstream with respect to the flow of the process air. The heat exchanger 300*c*1 corresponds to the first heat exchanger according to the present invention, and the heat exchanger 300*c*2 corresponds to a third heat exchanger according to the present invention.

As with the first embodiment or the third embodiment, the heat exchanger 300*c*1 may be a heat exchanger with the intermediate restrictions 331, 332, 333. In the example shown in FIG. 9, however, the heat exchanger 300*c*1 has no intermediate restrictions. In this embodiment, a refrigerant passage alternately extending through the first compartment 310 and the second compartment 320 repeatedly includes a first evaporating section, a first condensing section, a folded second condensing section, a second evaporating section, a folded third evaporating section, and a third condensing section. The heat exchanger 300*c*2 may be a heat exchanger with the intermediate restrictions 331, 332, 333. Either the heat exchanger 300*c*1 or the heat exchanger 300*c*2 may be a heat exchanger with intermediate restrictions.

The heat pump HP3 is arranged such that the refrigerant flowing out of the third condensing section of the heat exchanger 300*c*1 is introduced into the heat exchanger 300*c*2 via a pipe that bypasses the heat exchanger 300*c*1. In the embodiment shown in FIG. 9, the heat exchanger 300*c*2 is fully identical in structure to the heat exchanger 300*c*1.

The refrigerant pipe extending from the third condensing section of the heat exchanger 300*c*1 has a restriction 340 that serves as a fifth restriction. Specifically, the heat exchanger 300*c*1 and the heat exchanger 300*c*2 are connected via the restriction 340 in series with each other in the direction in which the refrigerant flows. The fifth restriction 340 is connected to the first evaporating section of the heat exchanger 300*c*2. The third condensing section of the heat exchanger 300*c*2 is connected to the restriction 250.

The compartment of the heat exchanger 300*c*2 for passing the process air therethrough serves as a fifth compartment, and the compartment of the heat exchanger 300*c*2 for passing the regeneration air serves as a sixth compartment. The process air which has flowed out of the desiccant wheel flows from the first compartment into the fifth compartment. The regeneration air which has been introduced from the outside space flows from the sixth compartment into the second compartment and then into the condenser 220.

Figure 10:
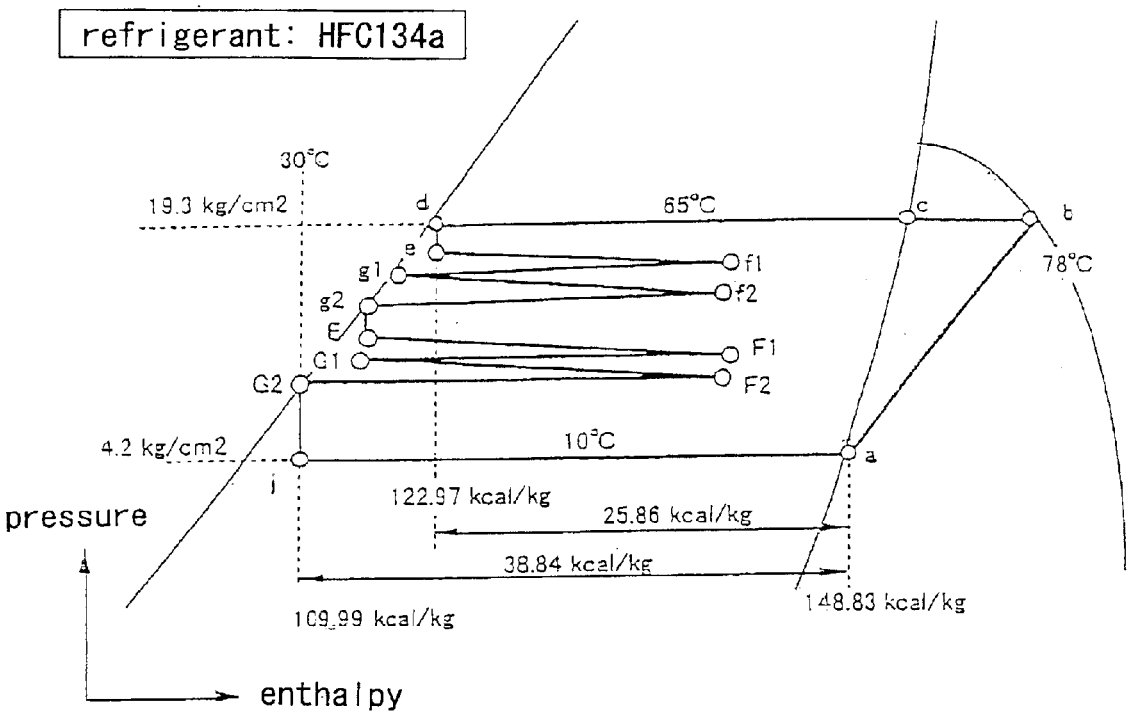
FIG. 10 is a Mollier diagram of the heat pump shown in FIG. 9.

Operation of the heat pump HP3 will be described below with reference to FIG. 10. The heat pump HP3 operates in the same manner as with the first and second embodiments up to the point e. The refrigerant at the point e is partly evaporated under the first intermediate pressure in the first evaporating section, and then reaches a point f1 in the wet region. The refrigerant from the point f1 is condensed in the first and second condensing sections, and reaches a point g1 on or near a saturated liquid curve. The refrigerant at the point g1 is partly evaporated in the second and third evaporating sections, and reaches a point f2. The refrigerant is condensed in the third condensing section, and reaches a point g2 on or near the saturated liquid curve.

The refrigerant at the point g2 is depressurized by the restriction 340, and reaches a point E under the second intermediate pressure. The refrigerant then flows into the first evaporating section of the heat exchanger 300*c*2. Thereafter, the refrigerant changes its state in the same manner as with the refrigerant in the heat exchanger 300*c*1, and reaches to a point G2 which corresponds to the point g4 shown in FIG. 3. The refrigerant is depressurized by the restriction 250, and reaches the state at a point j. Subsequently, the heat pump HP3 operates in the same manner as with the first and second embodiments.

Figure 11:
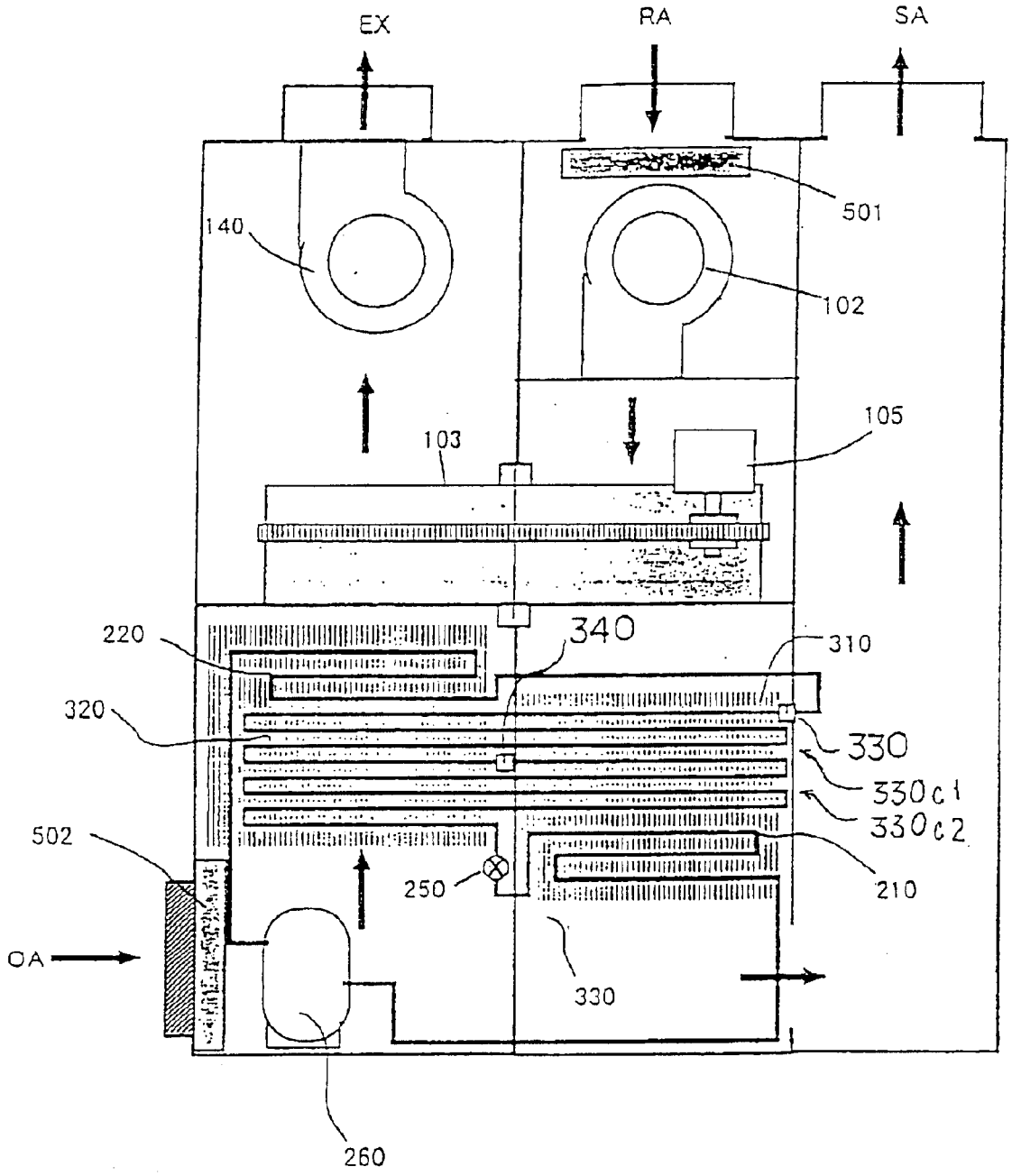
FIG. 11 is a cross-sectional front elevational view schematically showing an example of an actual structure of a dehumidifying air-conditioning apparatus having a heat pump according to the third embodiment of the present invention.

FIG. 11 shows a mechanical arrangement of the heat pump HP3 according to the third embodiment of the present invention and a dehumidifying air-conditioning apparatus having the heat pump HP3. In the present embodiment, the heat pump is free of the intermediate restrictions 331, 332, 333, but has the restriction 340 provided between the heat exchanger 300*c*1 and the heat exchanger 300*c*2. Other mechanical details of the present embodiment are identical to those shown in FIGS. 5 and 8.

Figure 12:
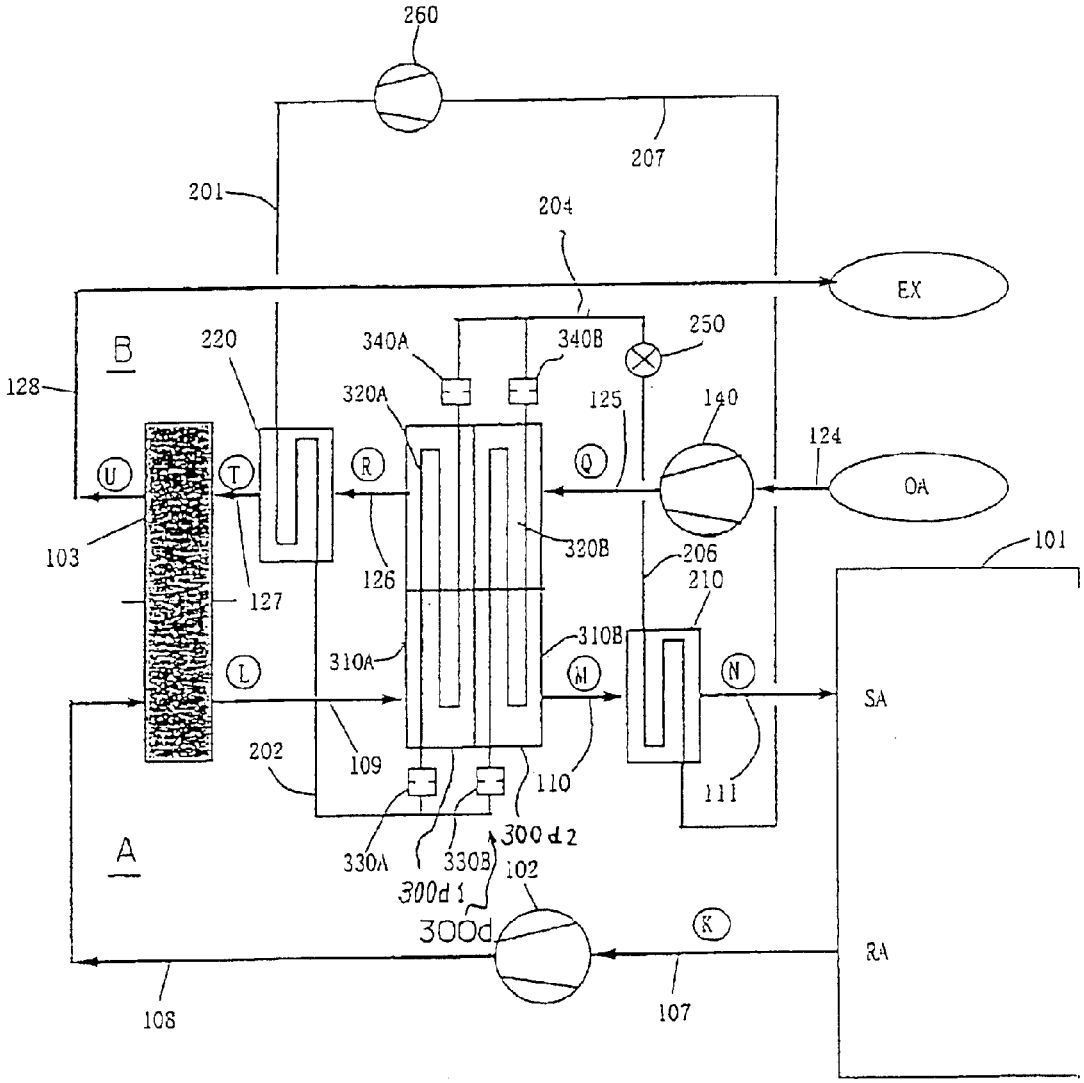
FIG. 12 is a flow diagram of a heat pump according to a fourth embodiment of the present invention and a dehumidifying air-conditioning apparatus having the heat pump.

A heat pump HP4 according to a fourth embodiment of the present invention and a dehumidifying air-conditioning apparatus incorporating the heat pump HP4 will be described below with reference to FIG. 12. In the present embodiment, a heat exchanger 300*d* for exchanging heat between the process air flowing out of the desiccant wheel 103 and the regeneration air flowing into the condenser 220 is divided into a heat exchanger 300*d*1 which is located upstream with respect to the flow of the process air and a heat exchanger 300*d*2 which is located downstream with respect to the flow of the process air. The heat exchanger 300*d*1 corresponds to the first heat exchanger according to the present invention, and the heat exchanger 300*d*2 corresponds to the second heat exchanger according to the present invention.

As with the first embodiment or the second embodiment, the heat exchanger 300*d*1 may be a heat exchanger with the intermediate restrictions 331, 332, 333. In the example shown in FIG. 12, however, the heat exchanger 300*d*1 has no intermediate restrictions. The heat exchanger 300*d*1 and the heat exchanger 300*d*2 are of substantially the same structure as the heat exchanger 300*c*1 and the heat exchanger 300*c*2.

According to the third embodiment, the heat exchanger 300*c*1 and the heat exchanger 300*c*2 are connected in series with each other via the restriction 340. According to the present embodiment, however, the heat exchanger 300*d*1 and the heat exchanger 300*d*2 have respective restrictions 330A, 330B connected to their inlets and respective restrictions 340A, 340B connected to their outlets, and are arranged in parallel with each other. Specifically, a refrigerant path 202 extending from the condenser 220 is branched into two paths connected respectively to the restrictions 330A, 330B. The restrictions 340A, 340B are connected to the refrigerant outlets of the heat exchanger 300*c*1 and the heat exchanger 300*c*2, and joined to a path 204 which is connected to the restriction 250. Either one of the restrictions 250, 340B may be dispensed with.

Figure 13:
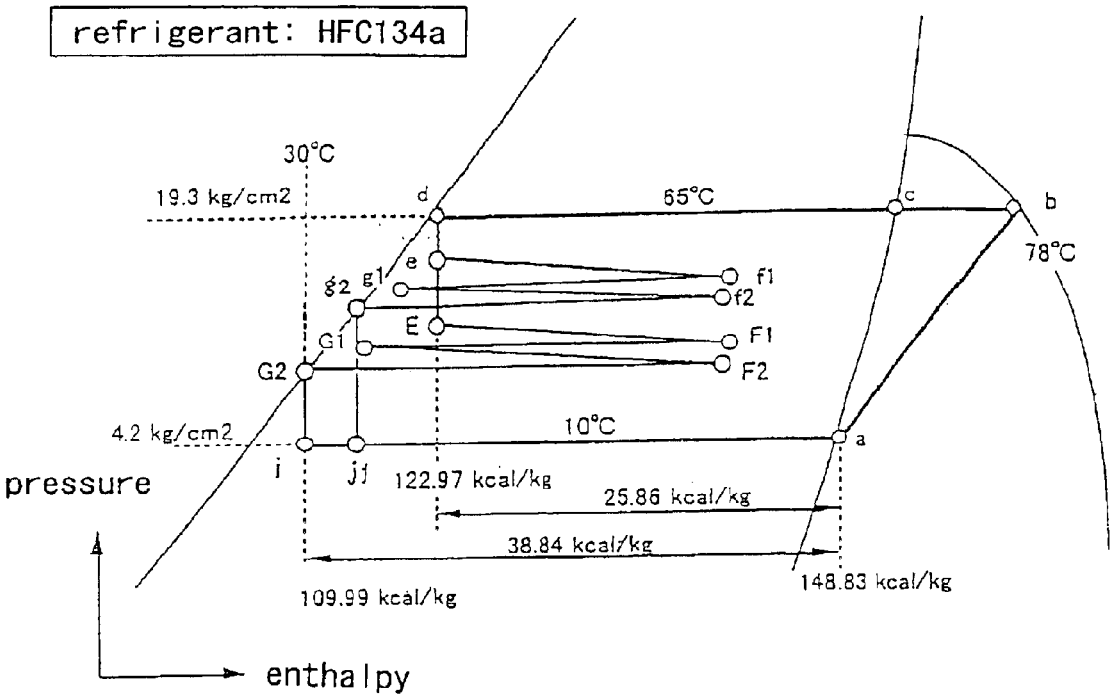
FIG. 13 is a Mollier diagram of the heat pump shown in FIG. 12.

Operation of the heat pump HP4 will be described below with reference to FIG. 13. In FIG. 13, the transitions to the point d are identical to those in the first, second and third embodiments. The refrigerant at a point d is divided from the path 202 into two paths, which deliver a substantially one half of the refrigerant to the restriction 330A and the remainder to the restriction 330B.

The refrigerant delivered to the restriction 330A is depressurized to the first intermediate pressure by the restriction 330A, and reaches a point e. The refrigerant at the point e is partly evaporated under the first intermediate pressure in the first evaporating section of the heat exchanger 300*d*1, and reaches a point f1 in the wet region. The refrigerant from the point f1 is condensed in the first and second condensing sections, and reaches a point g1 on or near a saturated liquid curve. The refrigerant at the point g1 is partly evaporated in the second and third evaporating sections, and reaches a point f2. The refrigerant is condensed in the third condensing section, and reaches a point g2 on or near the saturated liquid curve. The refrigerant at the point g2 is depressurized by the restriction 340A and the restriction 250, and reaches a point j1. The pressure at the point j1 is the same as the evaporating pressure in the evaporator 210.

Of the refrigerant at the point d, the refrigerant delivered to the restriction 330B is depressurized to an intermediate pressure lower than the first intermediate pressure by the restriction 330B, and reaches a point E. This is because the third compartment of the heat exchanger 300*d*2 for passing the process air is positioned downstream of the first compartment of the heat exchanger 300*d*1 with respect to the flow of the process air, and the fourth compartment of the heat exchanger 300*d*2 for passing the regeneration air is positioned upstream of the second compartment of the heat exchanger 300*d*1 with respect to the flow of the regeneration air, so that the evaporating temperature or the condensing temperature is low.

The refrigerant in the state at the point E changes its state in the same manner as the refrigerant in the heat exchanger 300*d*1, and finally reaches a point G2 on or near the saturated liquid curve. The refrigerant at the point G2 is depressurized by the restriction 340B and the restriction 250, and reaches a point j. The pressure at the point j is the same as the evaporating pressure in the evaporator 210. The mixture of the refrigerants at the points j1, j is evaporated in the evaporator 210.

Figure 14:
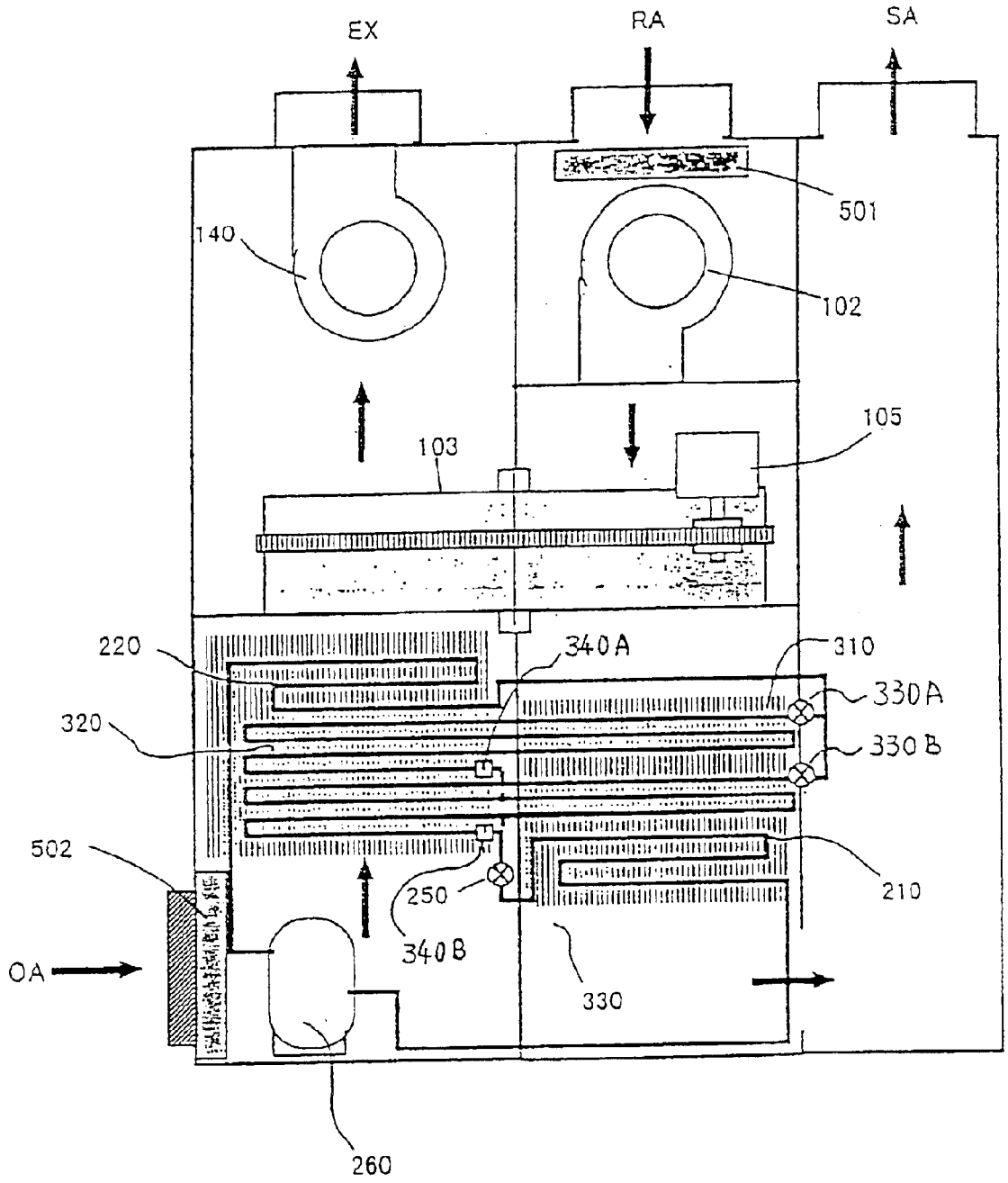
FIG. 14 is a cross-sectional front elevational view schematically showing an example of an actual structure of a dehumidifying air-conditioning apparatus having a heat pump according to the fourth embodiment of the present invention.

FIG. 14 shows a mechanical arrangement of the heat pump HP4 according to the fourth embodiment of the present invention and a dehumidifying air-conditioning apparatus having the heat pump HP4. In the present embodiment, the heat pump HP4 is free of the intermediate restrictions 331, 332, 333, and the restrictions 330A, 330B are connected to the respective inlets of the heat exchanger 300*d*1 and the heat exchanger 300*d*2 and the restrictions 340A, 340B are connected to the respective outlets of the heat exchanger 300*d*1 and the heat exchanger 300*d*2. Other mechanical details of the present embodiment are identical to those according to the first, second and third embodiments.

Figure 15:
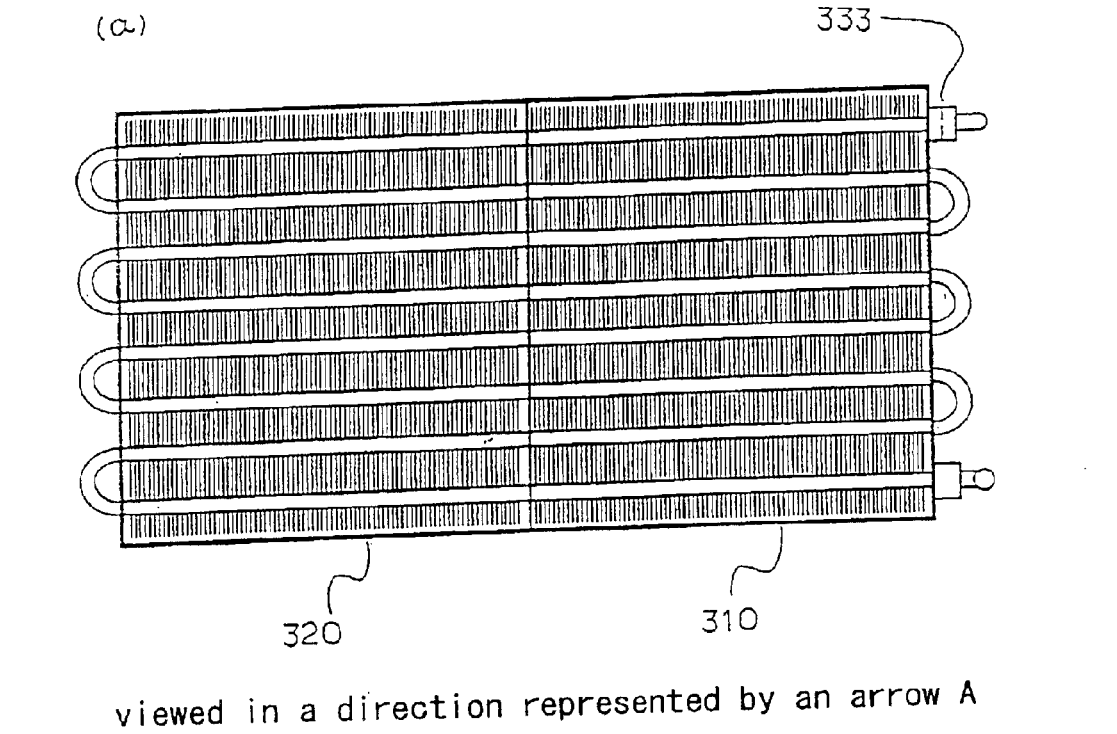
FIGS. 15(*a*) and 15(*b*) are schematic plan and side views, respectively, showing a heat exchanger suitable for use in a heat pump according to an embodiment of the present invention.

A structure of the first, second and third heat exchangers according to the present invention will be described below with reference to FIGS. 15(*a*) and 15(*b*), from the different viewpoint from the above description with reference to FIGS. 2(*a*) and 2(*b*). FIG. 15(*a*) is a plan view showing the heat exchanger as viewed in the direction in which the process air and the regeneration air are flowing, and FIG. 15(*b*) is a side elevational view showing the heat exchanger as viewed in a direction perpendicular to the flows of the process air and the regeneration air. In FIG. 15(*a*), the process air flows from the viewer toward the sheet, and the regeneration air from the sheet toward the viewer. In the heat exchanger, tubes are disposed in eight rows in each of the four planes PA, PB, PC, PD which lie perpendicularly to the flows of the process air and the regeneration air. Thus, the tubes are arranged in four tiers and eight rows along the flows of the process air and the regeneration air.

An intermediate restriction 331 is disposed in a transitional location from the first plane PA to the next plane PB. An intermediate restriction 332 (not shown) is disposed in a transitional location from the plane PB to the plane PC. An intermediate restriction 333 is disposed in a transitional location from the plane PC to the plane PD. While one restriction is provided in a transitional location from one plane to the next plane, tube rows in the plane PA may be arranged in a plurality of layers. In such an arrangement, an intermediate restriction is disposed in a transitional location from each layer to the next layer. Planes prior and subsequent to an intermediate restriction are referred to as first and second planes, respectively.

Heat exchangers each having tubes in eight rows and four layers (tiers) as shown in FIGS. 15(*a*) and 15(*b*) may be arranged in parallel with each other or in series with each other with respect to the flows of the process air and the regeneration air, depending on the amount of the process air and the regeneration air.

In the Mollier diagram shown in FIG. 3, for example, the cycle is effective even if the refrigerant is repeatedly evaporated and condensed into a subcooled region beyond the saturated liquid curve. In view of the heat exchange between the flows of the process air and the regeneration air, however, the refrigerant should preferably change its phase in the wet region. With the heat exchanger shown in FIG. 2 or FIG. 15, therefore, the heat transfer area of the first evaporating section connected to the restriction 330 should preferably be larger than the heat transfer area of the subsequent evaporating section. Furthermore, since the refrigerant flowing into the restriction 250 is preferably in the saturated or subcooled region, the heat transfer area of the condensing section connected to the restriction 250 should preferably be larger than the heat transfer area of the prior condensing section.

Figure 16:
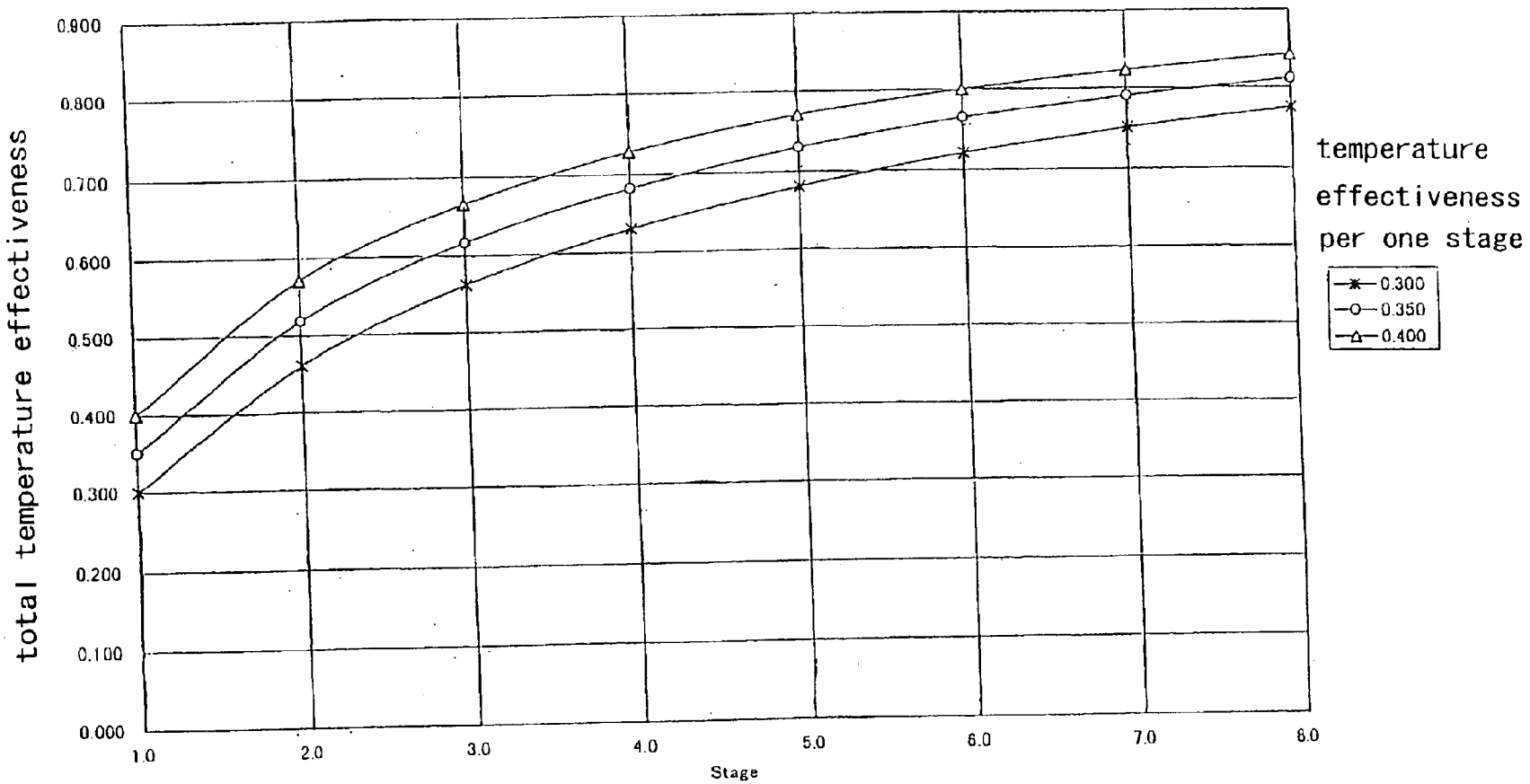
FIG. 16 is a diagram showing the relationship between the number of stages of a heat exchange tube and the temperature effectiveness.
Figure 17:
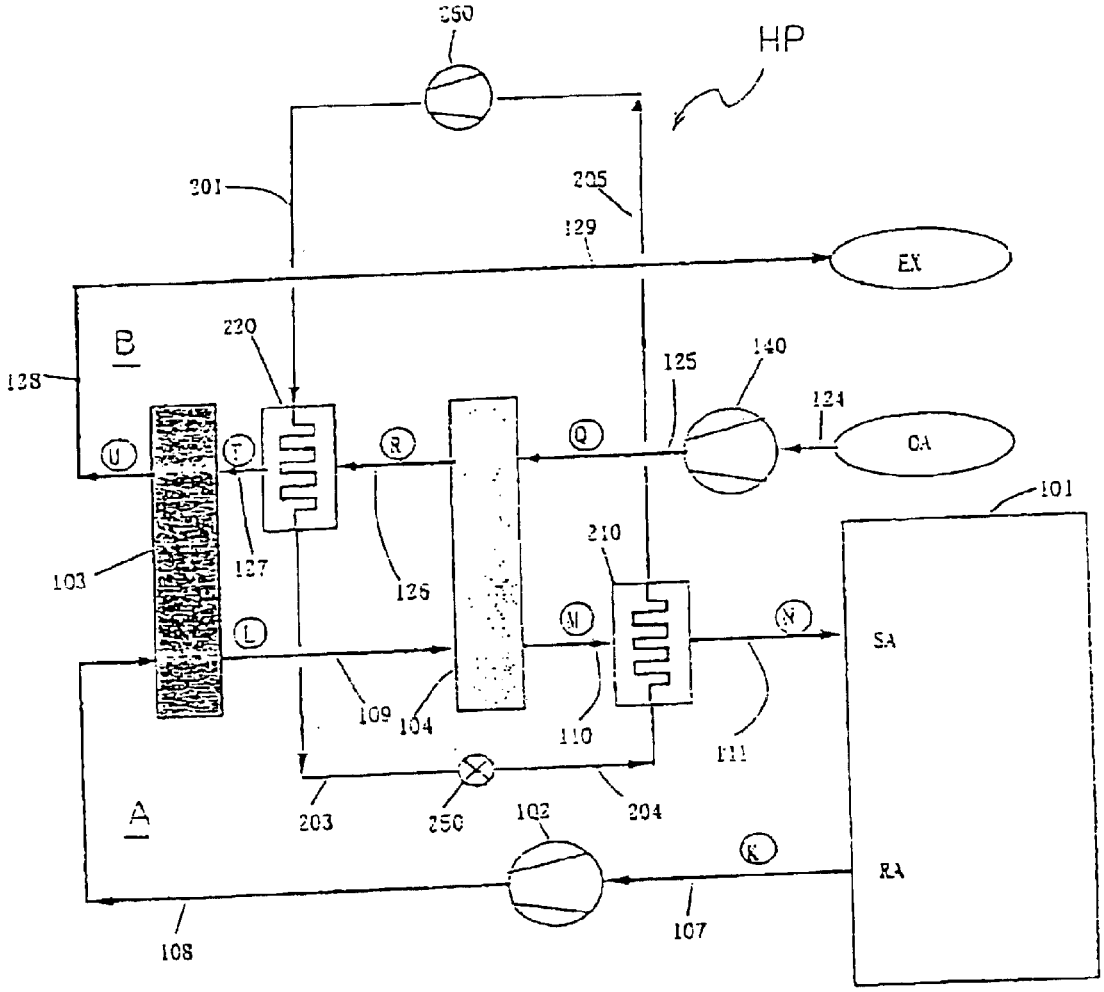
FIG. 17 PRIOR ART
FIG. 17 is a flowchart of a conventional heat pump and a conventional dehumidifying air-conditioning apparatus.
Figure 18:
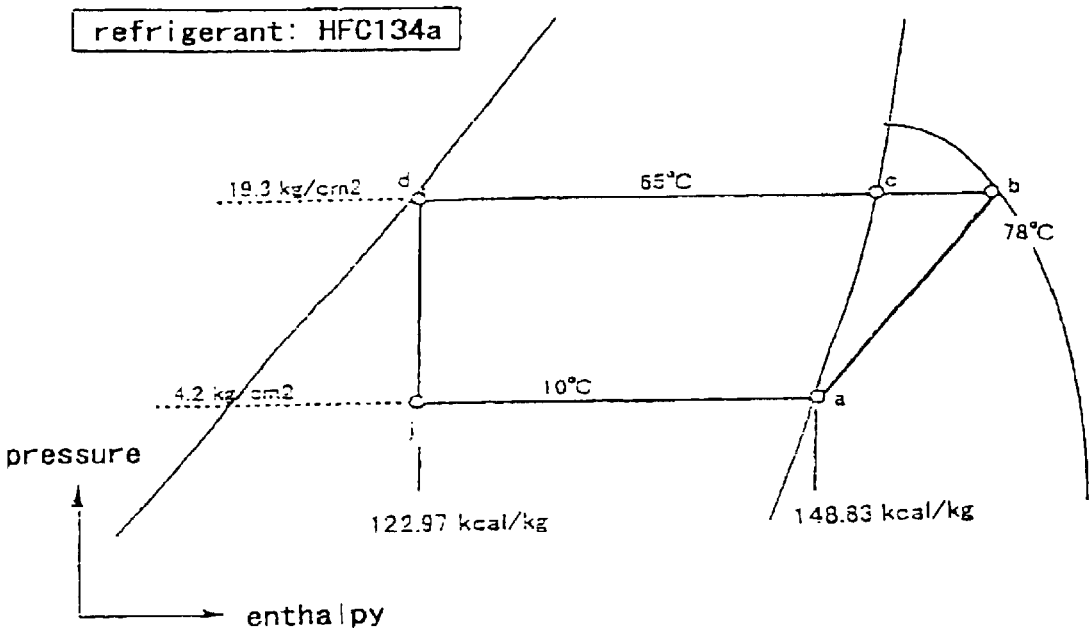
FIG. 18 PRIOR ART
FIG. 18 is a Mollier diagram of the conventional heat pump shown in FIG. 17.

The relationship between the total temperature effectiveness (heat exchange efficiency) and the number of stages of the heat exchange tubes along the flow of the process air or the regeneration air which are divided by the intermediate restrictions, which can be referred to the number of layers or the number of lines and corresponds to the number of planes in FIG. 15, will be described below with reference to FIG. 16. If the temperature effectiveness per one stage is 0.400, for example, then the total temperature effectiveness is about 0.67 for three stages, about 0.72 for four stages, about 0.77 for five stages, and about 0.80 for six stages. Further increases in the number of stages do not result in any appreciable increases in the total temperature effectiveness. Therefore, it is preferable to use about four stages from the standpoint of cost effectiveness.

In the above embodiments, the compressor is used as a pressurizer. However, a pressurizer may comprise an absorber for absorbing a refrigerant with an absorbent solution, a pump for pressurizing the absorbent solution which has absorbed the refrigerant, and a generator for generating the refrigerant from the pressurized absorbent solution, which are used in an absorption chiller.

INDUSTRIAL APPLICABILITY

According to the present invention, as described above, since the refrigerant repeatedly passes alternately through refrigerant passages which extend through first and second compartments, the refrigerant flowing through an evaporator or a condenser passes through the first and second compartments a plurality of times, and can be used a plurality of times to exchange heat between a low-temperature heat source fluid and a high-temperature heat source fluid. Therefore, the refrigerant will not be completely dried out even if it is evaporated in the refrigerant passage extending through the first compartment.

What is claimed is:

1. A heat pump comprising:

a pressurizer for raising a pressure of a refrigerant;

an evaporator for cooling a low-temperature heat source fluid with heat of evaporation of the refrigerant to be pressurized by said pressurizer;

a condenser for heating a high-temperature heat source fluid with heat of condensation of the refrigerant pressurized by said pressurizer; and a first heat exchanger for exchanging heat between said low-temperature heat source fluid upstream of said evaporator and said high-temperature heat source fluid;

wherein said first heat exchanger has a first compartment through which said low-temperature heat source fluid flows, a second compartment through which said high-temperature heat source fluid flows, and a refrigerant passage extending through said first compartment and said second compartment, said refrigerant passage being connected from said condenser through a first restriction, extending alternately through said first compartment and said second compartment repeatedly, and then being connected to said evaporator through a second restriction.

2. A heat pump according to claim 1 further comprising a second heat exchanger for exchanging heat between said low-temperature heat source fluid upstream of said evaporator and said high-temperature heat source fluid;

wherein said second heat exchanger has a third compartment through which said low-temperature heat source fluid flows, a fourth compartment through which said high-temperature heat source fluid flows, and a refrigerant passage extending through said third compartment and said fourth compartment, said refrigerant passage being connected from said condenser through a third restriction, extending alternately through said third compartment and said fourth compartment repeatedly, and then being connected to said evaporator through a fourth restriction; and said third compartment is disposed downstream of said first compartment with respect to said low-temperature heat source fluid, and said fourth compartment is disposed upstream of said second compartment with respect to said high-temperature heat source fluid.

* * * * *

UNITED STATES PATENT AND TRADEMARK OFFICE

CERTIFICATE OF CORRECTION

PATENT NO. : 6,813,894 B2
DATED : November 9, 2004
INVENTOR(S) : Kensaku Maeda

It is certified that error appears in the above-identified patent and that said Letters Patent is hereby corrected as shown below:

Title page,
Item [54], Title, please change "HEAT PUMP AND DEHUMIDIFIER" to
-- HEAT PUMP AND DEHUMIDIFING APPARATUS --

Signed and Sealed this

Thirty-first Day of May, 2005

JON W. DUDAS
*Director of the United States Patent and Trademark Office*